US006205934B1

(12) United States Patent
Felton et al.

(10) Patent No.: US 6,205,934 B1
(45) **Date of Patent: *Mar. 27, 2001**

(54) SUPPORT AND RELATED SHELF

(75) Inventors: J. Reed Felton, Wauwatosa; Douglas G. Lawrence, Rubicon, both of WI (US)

(73) Assignee: Versatile Products LLC, Menomonee Falls, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/336,899

(22) Filed: Jun. 21, 1999

Related U.S. Application Data

(63) Continuation of application No. 09/209,501, filed on Dec. 11, 1998, now Pat. No. 6,053,115.

(51) Int. Cl.[7] ..... A47B 9/00

(52) U.S. Cl. ..... 108/107; 100/110

(58) Field of Search ..... 108/107, 106, 108/110, 144.11, 147.16, 147.17; 211/107, 190, 191, 200, 207, 193

(56) References Cited

U.S. PATENT DOCUMENTS

| | | | | |
|---|---|---|---|---|
| 605,291 | * | 6/1898 | Hunter | 108/110 |
| 810,545 | * | 1/1906 | Krag | 108/110 |
| 1,080,203 | * | 12/1913 | Dungan | 108/107 |
| 2,346,430 | * | 4/1944 | Hauser | 108/110 X |
| 6,053,115 | * | 4/2000 | Felton | 108/110 X |

FOREIGN PATENT DOCUMENTS

| | | | | |
|---|---|---|---|---|
| 23063 | * | 4/1913 | (GB) | 108/110 |

* cited by examiner

*Primary Examiner*—Jose V. Chen
(74) *Attorney, Agent, or Firm*—Quarles & Brady, LLP

(57) ABSTRACT

A shelving apparatus for use with a rigid frame member wherein the apparatus includes at least one shelf member having a longitudinal axis and an end surface coincident therewith, first and second coupler pairs mounted to the shelf member and frame member, respectively, the second pair delineating a clearance region within a coupling plain, the couplers including first and second pins and first and second slot delineators which are operative to support the shelf in any of several different positions including at least one essentially horizontal position and which are configured and juxtaposed such that the shelf member can easily be dismounted from the frame member so that the first and second couplers pass into the clearance region.

32 Claims, 19 Drawing Sheets

FIG. 1
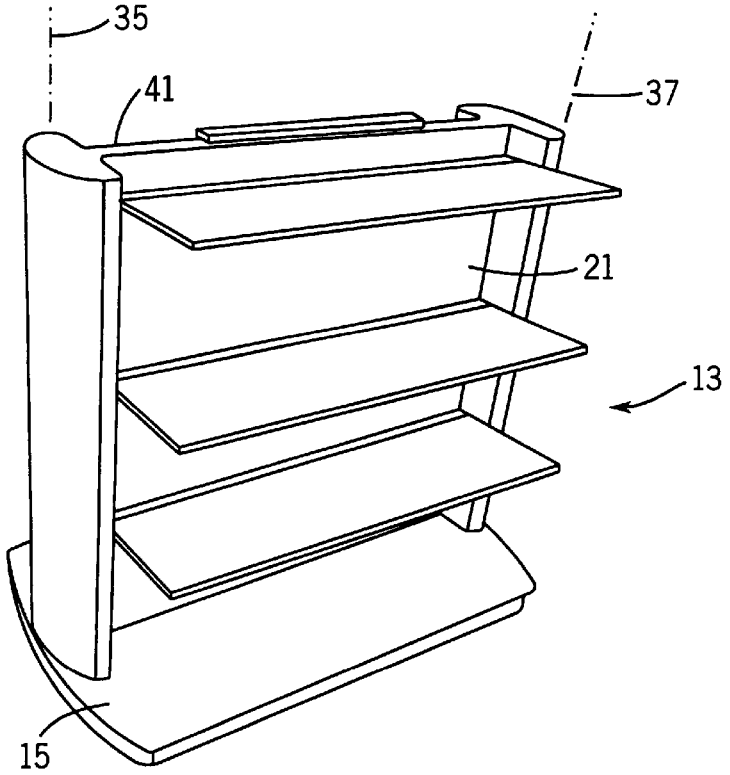
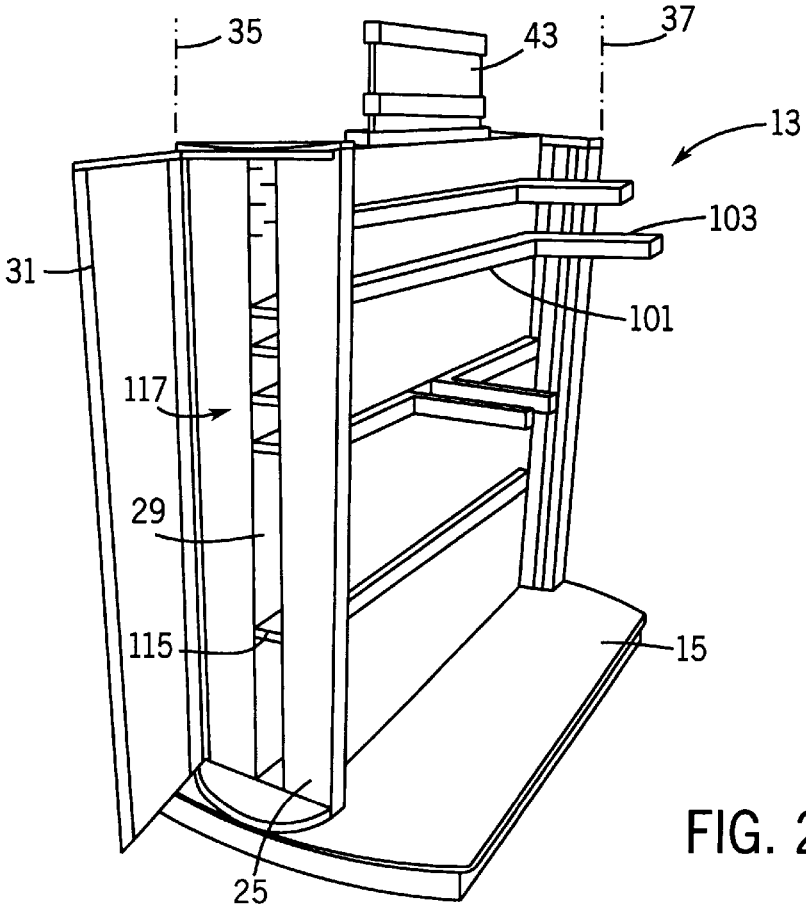
FIG. 2

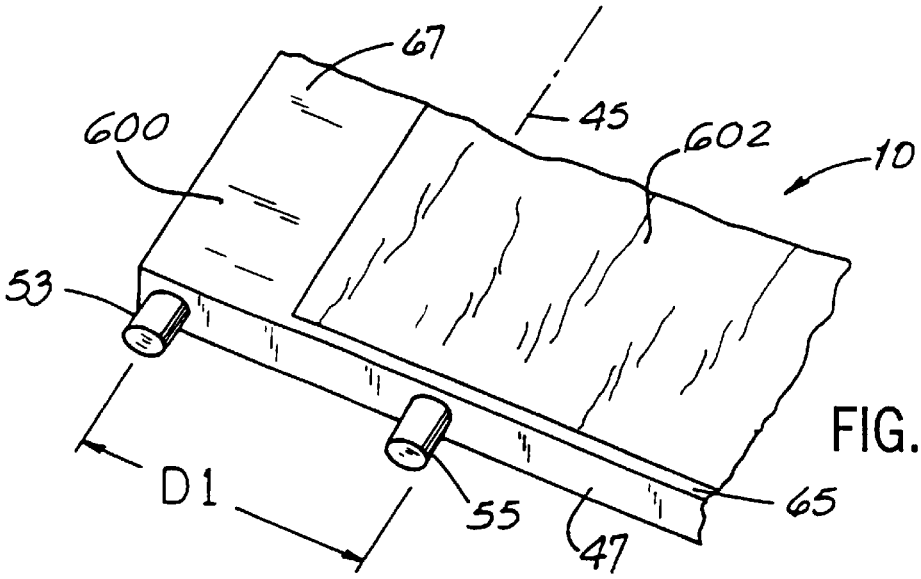
FIG. 7
FIG. 8
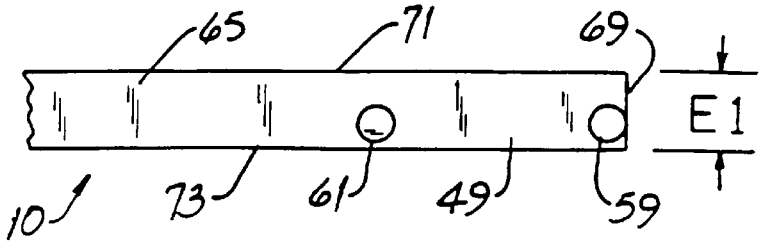
FIG. 9
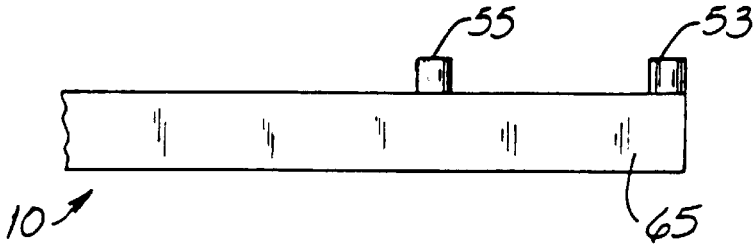
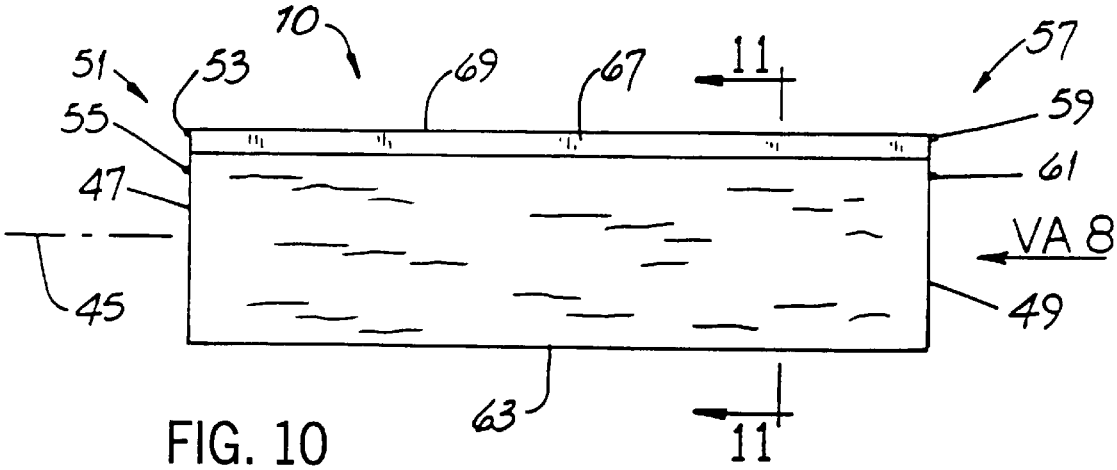
FIG. 10

FIG. 11
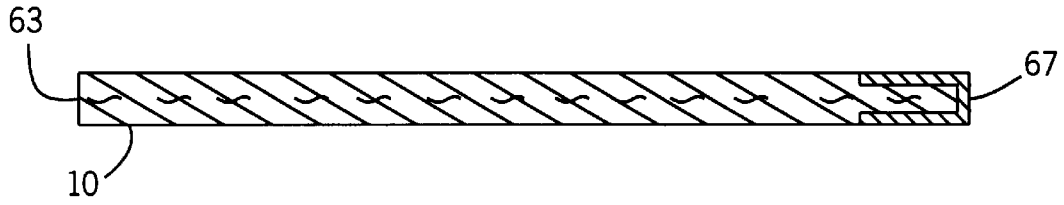
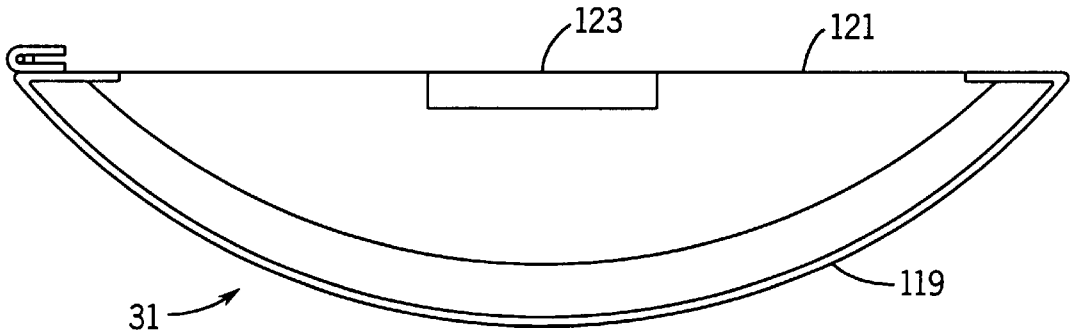
FIG. 17
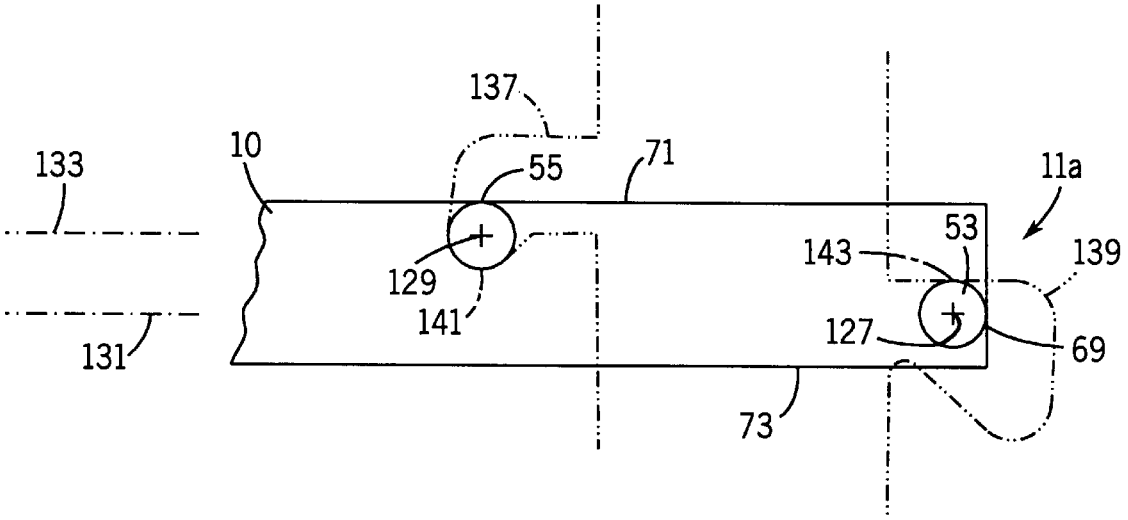
FIG. 18

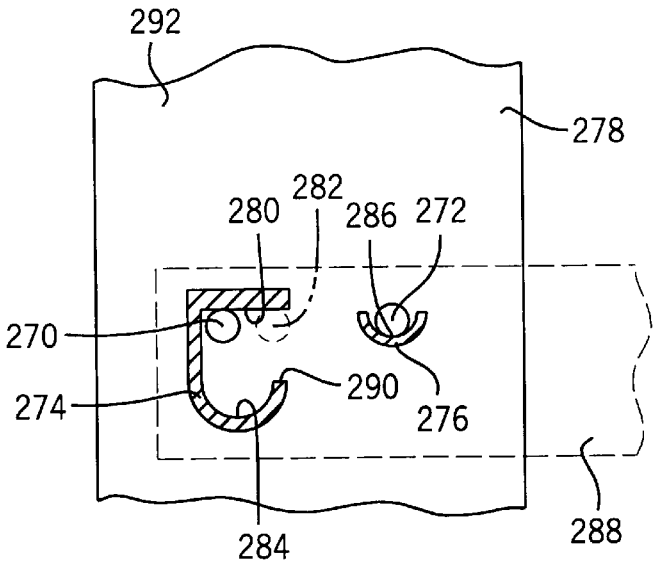
FIG. 24
FIG. 25
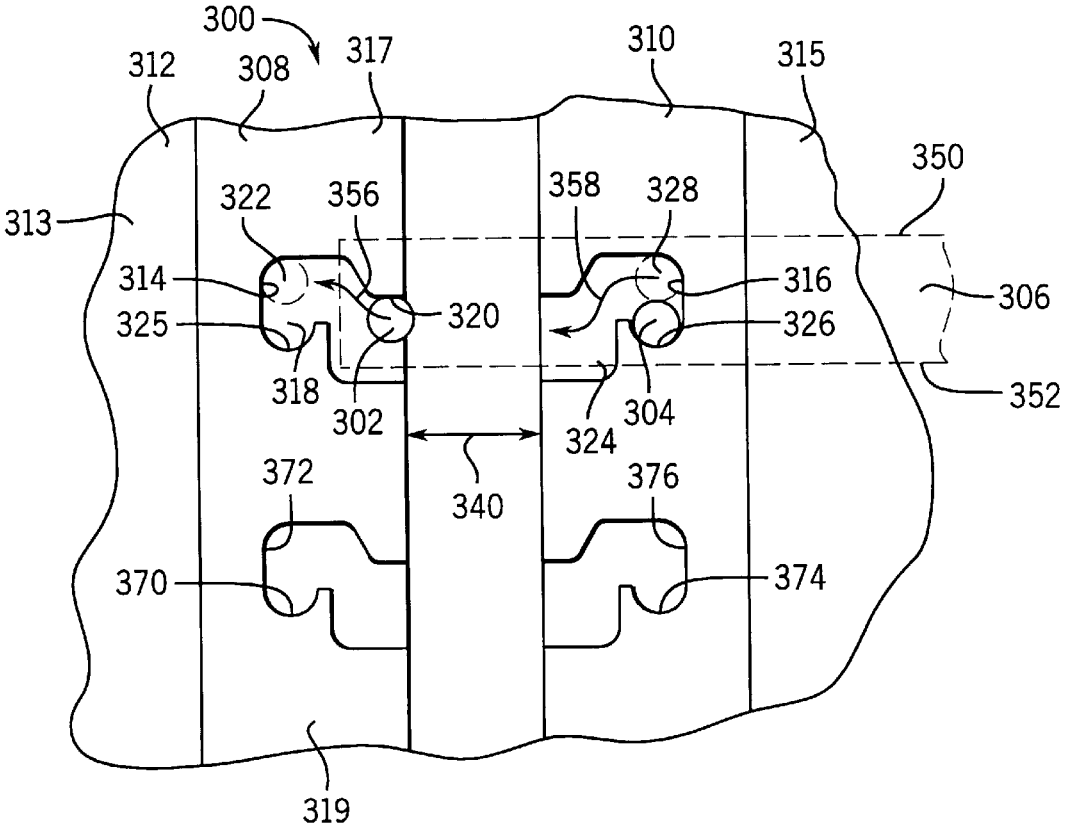

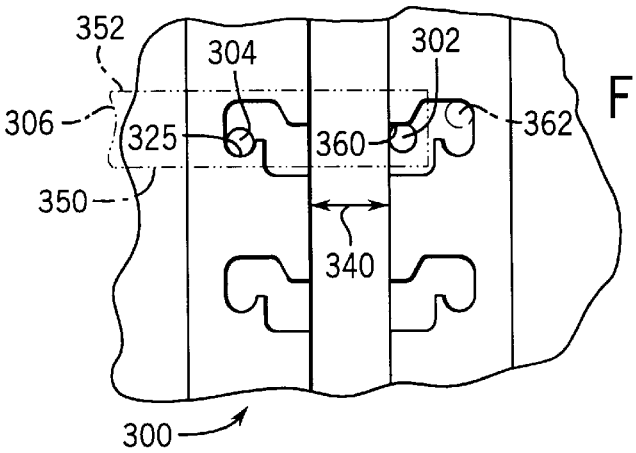
FIG. 26
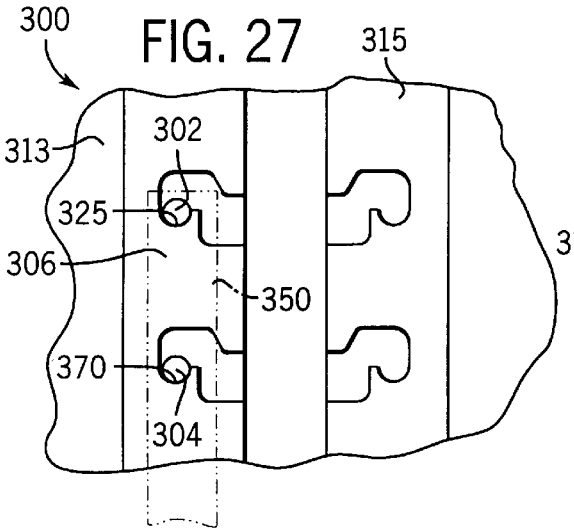
FIG. 27
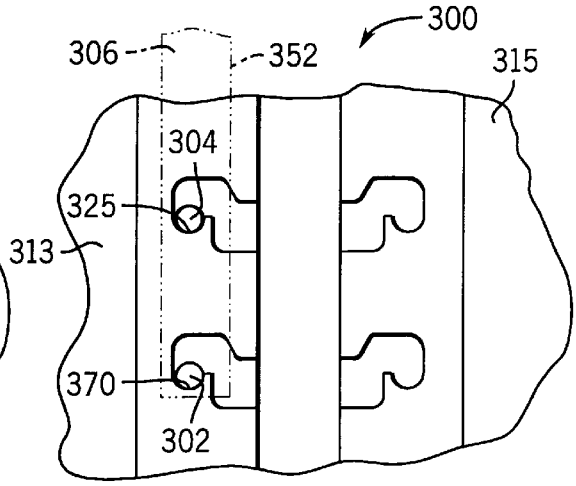
FIG. 29
FIG. 28
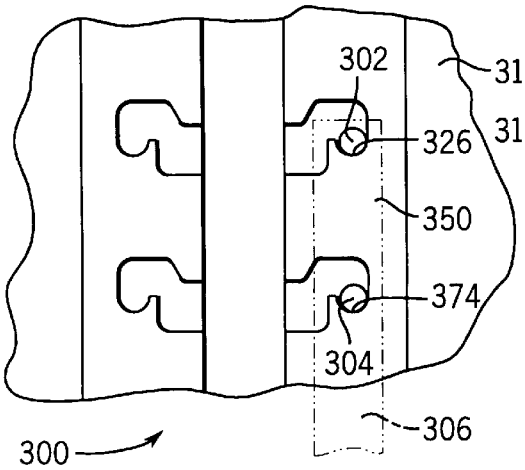
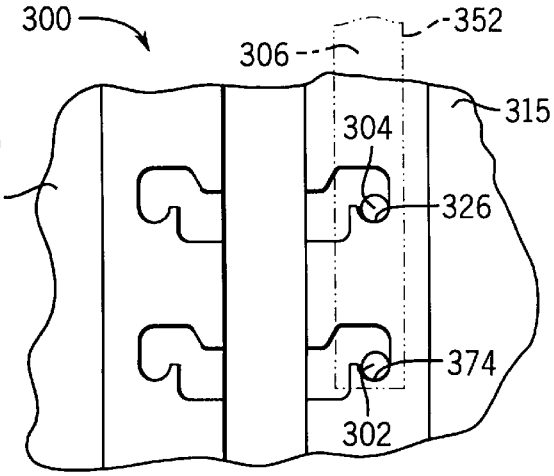
FIG. 30

FIG. 32
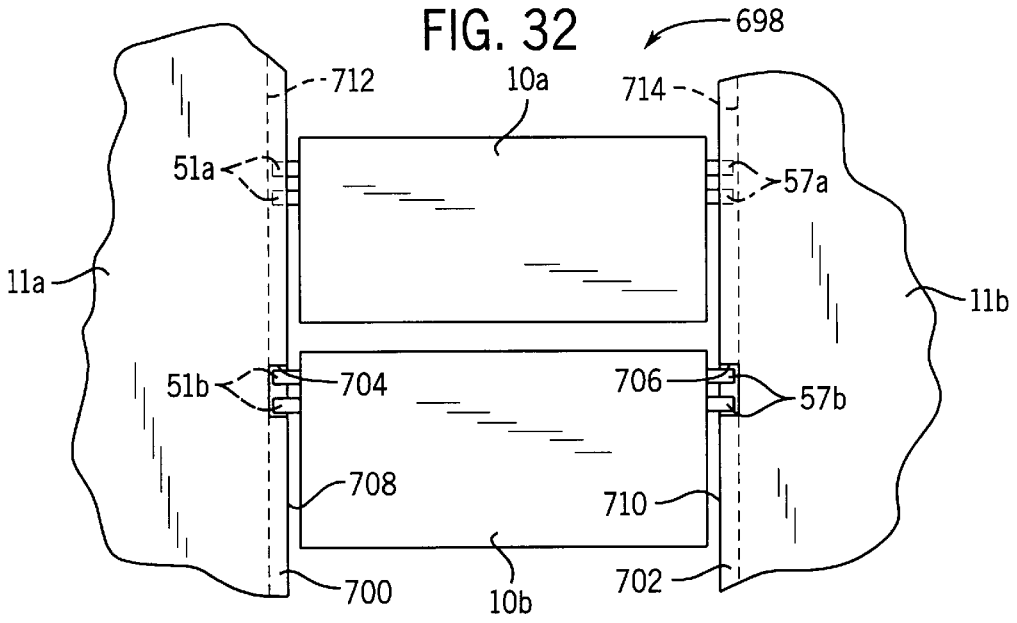
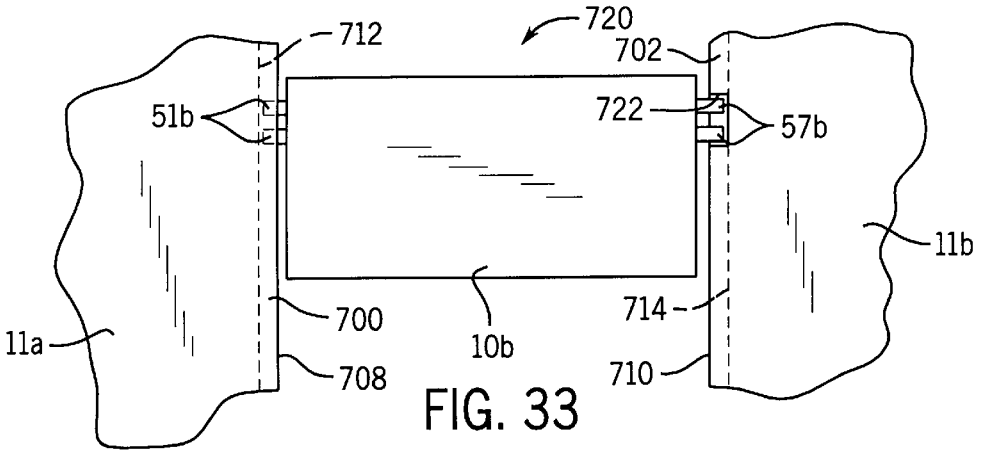
FIG. 33
FIG. 34
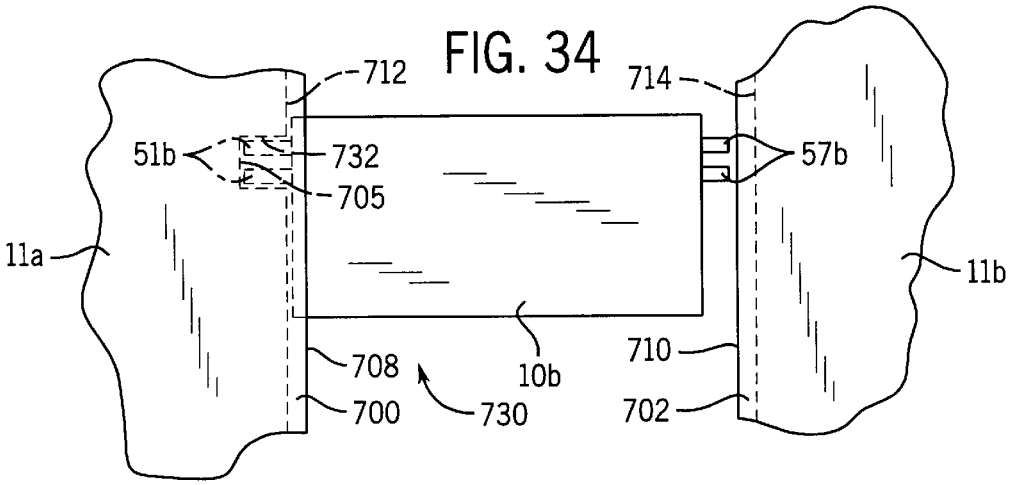

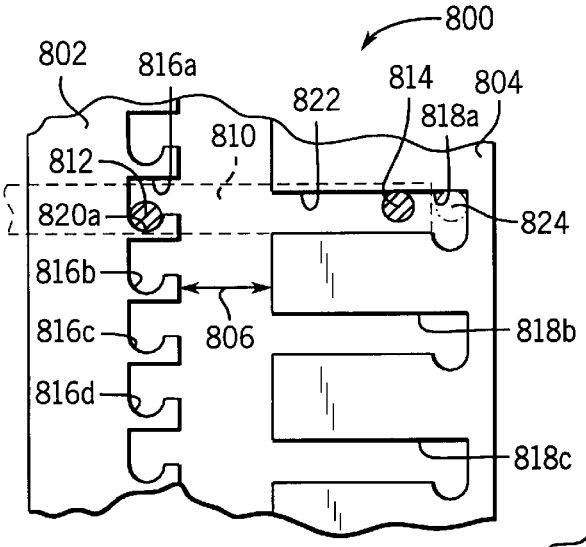
FIG. 37
FIG. 38
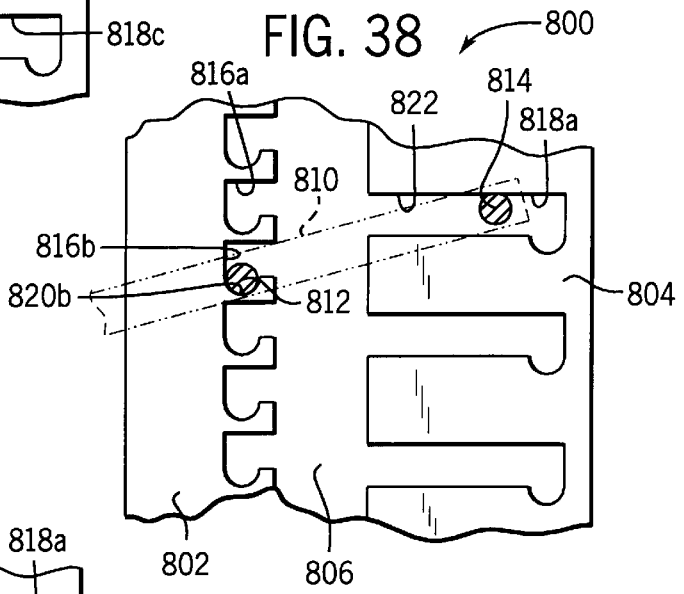
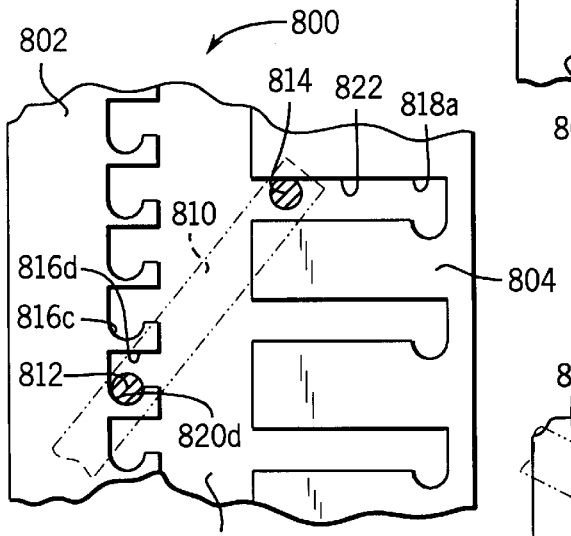
FIG. 39
FIG. 40
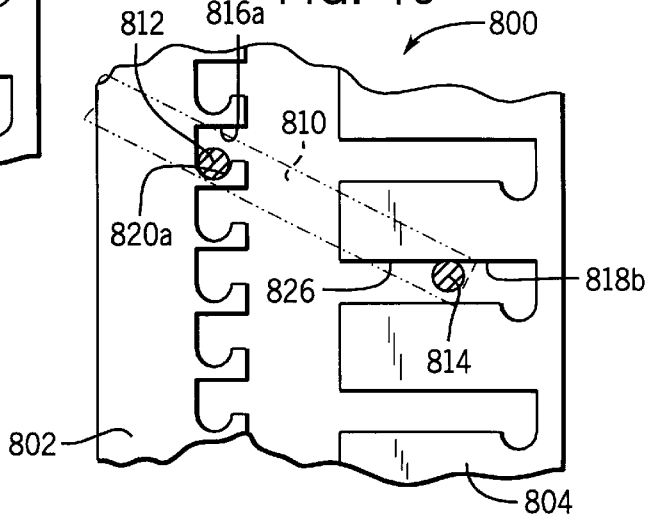

SUPPORT AND RELATED SHELF

CROSS REFERENCE TO RELATED APPLICATIONS

This application is a continuation in part of U.S. patent application Ser. No. 09/209,501 entitled SUPPORT AND RELATED SHELF which was file on Dec. 11, 1998 now U.S. Pat. No. 6,053,115.

STATEMENT REGARDING FEDERALLY SPONSORED RESEARCH OR DEVELOPMENT

Not applicable.

BACKGROUND OF THE INVENTION

This invention relates generally to racks and rack-type supports having horizontal planar surfaces and, more particularly, to such racks and supports of the type having a removable shelf.

It is well recognized that a wide variety of racks and rack-type supports are known. Examples of but a few types are disclosed in U.S. Pat. Nos. 1,805,989 (Levene), 1,990,756 (Saaf), 5,127,340 (Maro et al.) and 5,607,070 (Hellyer). While these arrangements have been generally satisfactory for their intended purposes, they are not without disadvantages for certain applications.

For example, the shelves disclosed in the Levene patent must be bolted in place and unbolted to be removed and, if desired, stored. Where time has value, as is usually the case in a work environment, the arrangement is cumbersome. While the shelves disclosed in the Saaf patent may be more quickly mounted and removed, that convenience requires a shelf having pins mounted for pivoting movement into and out of supporting holes.

For greatest flexibility in erection, use and "tear-down, a scaffold should have a shelf-like platform which can be readily mounted and, just as readily, removed. Home entertainment centers, another type of product having one or more shelves, are most preferably configured so that the vertical spacing between shelves can be selected consistent with the vertical height of the components, e.g., tuner, compact-disc player, amplifier or the like, which are intended to rest upon such shelves. Structures like that disclosed in the Levene patent do not lend themselves easily to such uses.

Another type of rack with one or more shelves is embodied as mounted or freestanding units used to display retail products for sale. Such units are often referred to in the industry as "store fixtures." Most preferably, stores fixtures should be aesthetically attractive, permit easy reconfiguration for displaying any of a variety of types of products and have features easily adapted to integration of advertising graphics or the like.

U.S. Pat. No. 5,816,419 describes one display-type shelving unit which includes a plurality of shelves mounted to laterally spaced posts. Each shelf is mounted using two special brackets which cooperate with slots and recesses in the shelf to support the shelf in a horizontal position, to hang the shelf in an essentially vertical position, or to maintain the shelf in an angled position. While this solution facilitates quick and easy movement of each shelf among its three possible positions, this solution does not enable shelf removal, facilitate changing the vertical positions of each shelf and facilitate various other useful shelving arrangements.

Yet another product which advantageously includes one or more flat surfaces having adjustable height includes a flat-surface desk which may be used by multiple persons. For example, in factories which have more than one shift, often persons who use a desk during different shifts are different heights. To comfortably accommodate users having various heights it is advantageous to have an adjustable-height desk top.

An improved support and shelf which responds to the needs described above would be an important advance in this field of technology.

OBJECTS OF THE INVENTION

It is an object of the invention to provide an improved support and shelf which addresses problems and shortcomings of the prior art.

Another object of the invention is to provide an improved support and shelf arrangement which can be quickly reconfigured.

Another object of the invention is to provide an improved support and shelf arrangement which permits rapid mounting and de-mounting of a shelf.

Yet another object of the invention is to provide an improved support and shelf arrangement which permits "self-storing" of a shelf.

Another object of the invention is to provide an improved support and shelf arrangement which, in particular embodiments, involves a store fixture.

One other object is to provide an extremely strong shelving unit which can withstand relatively large weight.

Yet another object is to provide a shelving system wherein, when one shelf is hanging in a stored position, other shelves may be moved vertically with respect to the stored shelf without disturbing the stored shelf.

One more object is to take advantage of the surfaces of a stored shelf for various secondary purposes such as advertising, changing the appearance of a shelving unit, mounting of a mirror and so on.

A further object is to provide a shelving system wherein the vertical position of a shelf, the extending direction (i.e. forward or rearward) of the shelf and the direction in which surfaces face, can easily be modified.

Another object of the invention is to provide a shelving system wherein shelves can be supported in any of several different positions including several different positions which are angles with respect to a horizontal plane.

How these and other objects are accomplished will become apparent from the following descriptions and from the drawings.

SUMMARY OF THE INVENTION

The invention involves the combination of a shelf having a longitudinal axis and an end surface coincident with such axis. It also involves an apparatus for supporting the shelf at such end surface. In the improvement, the shelf includes first and second support pins extending from the end surface in a direction parallel to the axis and defining a first spacing dimension. The apparatus includes a support member having first and second slots, each with a pin-support portion. A clearance region is between such pin-support portions and between the slots.

The clearance region has first and second boundaries and the second slot includes a pivot portion. Such pivot portion and the first boundary define a second spacing dimension slightly greater than the first spacing dimension.

More specifically, the pin-support portion of the first slot is shaped to conform to the shape of the first support pin.

And the second pin is arcuate as is the pivot portion of the second slot. In a highly preferred embodiment, the support member is vertical and when the first and second support pins are in registry with the pin-support portions of the first and second slots, respectively, the shelf extends along a substantially horizontal plane.

As to other relationships of components of the new combination, when the second support pin is in registry with the pivot portion of the second slot, the shelf is angled with respect to the horizontal plane. And when such second support pin is in registry with the pivot portion of the second slot and when the shelf is angled with respect to the horizontal plane, the first support pin is spaced below the pin-support portion of the first slot.

In a specific embodiment suitable for self-storing of shelves on the support member, the apparatus has a third slot spaced below the first slot and a fourth slot spaced below the second slot. When the second support pin is in registry with the pivot portion and the shelf is angled with respect to the horizontal plane, e.g., perpendicular to such plane, the first support pin is in the fourth slot.

And the new combination of the shelf and support apparatus has yet additional features when further combined with a hang bar. More specifically, the shelf has an edge defining an edge dimension and the hang bar has a mounting bracket defining a bracket dimension slightly greater than the edge dimension. When the shelf edge and hang bar mounting bracket are so configured, the hang bar may be mounted securely on the shelf by slipping the mounting bracket downwardly over the shelf edge.

A particular embodiment of the invention is configured as a store fixture having plural shelves on which products, e.g., dry goods, may be displayed for sale. Such store fixture has an upright frame with first and second end stanchions. First and second lateral support members fixed with respect to the frame and, specifically, are fixed with respect to the first and second stanchions, respectively. Each support member has a plurality of vertically spaced slot sets, each slot set including first and second slots. Each of the first and second slots of each slot set has a pin-support portion and a clearance region is between the slots.

A plurality of shelves is mounted between the support members and each shelf has a longitudinal axis and a pair of spaced end surfaces coincident with such axis. Each shelf end surface has first and second support pins extending axially from it. The support pins at each end surface of each shelf define a first spacing dimension.

Further, each of the clearance regions has first and second boundaries and each of the second slots includes a pivot portion. As to the first lateral support member, the pivot portions of each of its second slots and its first boundary define a second spacing dimension slightly greater than the first spacing dimension.

The new store fixture is preferably configured to permit storing, out of sight, unused shelves. Such fixture includes a storage section between the lateral support members. The storage section has a pair of spaced wall members extending between the stanchions. In the preferred fixture, there is at least one support device, e.g., a shelf-like "rail" or the like, extending between and affixed to the wall members. The wall members and the support device form an elongate storage tunnel for receiving a shelf therein for storage.

The fixture also has an end closure mounted for movement with respect to the frame, thereby permitting the storage tunnel to be opened and closed. Most preferably, the end closure is mounted for pivoting movement about a vertical axis and includes an exterior panel formed of a material which is either translucent or transparent so that light can be transmitted therethrough. An interior panel supports a lamp, the light from which is visible through the exterior panel.

And that is not all. The preferred new store fixture also has, in addition to the back lighted exterior panel, other features permitting use of visual graphics. The spaced wall members also define a vertically-oriented gap between them. An aesthetically pleasing closure member is atop the gap. There is a sign board mounted for vertical movement with respect to the closure member, thereby configuring the sign board to be displayed above the closure member or received in the gap for storage.

The invention also includes a support apparatus for use with a rigid frame member, the apparatus including at least one shelf-member having a longitudinal axis and an end surface coincident with the axis, a first coupler pair including first and second couplers mounted to the end surface and a second coupler pair including third and fourth couplers mounted to the frame member within a coupling plane, the second pair delineating at least one clearance region within the coupling plane, the couplers operative to selectively mount and dismount the shelf member to the frame member. The couplers include first and second pins and first and second slot delineators, the first and second delineators defining first and second pin support surfaces and forming first and second passageways from the first and second support surfaces, respectively, each passageway wide enough for one of the pins to pass through.

When the shelf member is mounted to the frame member, the pins are essentially parallel to the axis, the passageways defining paths which are essentially perpendicular to the axis, are within the coupling plane and which open into the clearance region. With the first and second pins received on the first and second support surfaces, respectively, the shelf member is supported in a first position and the paths are essentially perpendicular to the axis, within the coupling plane and open into the clearance region so that the shelf member is dismountable from the frame member by moving the shelf member perpendicular to the axis such that the pins pass through the paths and the first and second couplers pass into the clearance region.

In one embodiment the first and second pins are connected to the frame member. In the alternative, the first and second pins are connected to the shelf member.

Preferably, the third and fourth couplers are upper couplers and the apparatus further include a lower coupler pair including lower third and fourth couplers which are identical to the upper third and fourth couplers and which are mounted to the frame member vertically below the third and fourth couplers, respectively, such that the second coupler pair and the lower coupler pair are operative to support the shelf member in a second position vertically below the first position with the first and second pins received on lower coupler support surfaces, respectively, the clearance region defining at least one clearance path within the coupling plane between the second and lower coupler pairs which is wide enough for the first and second couplers to pass through.

Also, preferably, the apparatus further includes a hanging delineator which forms a hanging surface and a hanging pin, one of the hanging surface and hanging pin linked to the shelf member and the other of the hanging surface and hanging pin linked to the frame member, when the shelf member is mounted to the frame member, the hanging surface and hanging pin essentially parallel to the axis and within the coupling plane and, wherein, the hanging delineator and hanging pin are operative to mount and support the shelf member in an essentially vertical position with the hanging pin received on the hanging surface.

In one embodiment one of the delineators forms the hanging surface, and one of the coupler pins forms the hanging pin. In one embodiment the upper third coupler is one of the hanging delineator or the hanging pin and the upper and lower third couplers are vertically spaced such that, when the shelf member is supported in the vertical position, each of the first and second pins is received within a separate one of the third delineators. Also, each of the coupler pins may be operative as a hanging pin.

The second coupler pair couplers may be separated by the clearance region, the coupler mounted to the shelf member which is operative along with second coupler pair for hanging purposes may be a hanging coupler and, the hanging coupler may be operative with the upper third coupler to support the shelf member in the vertical position on a first side of the clearance region wherein the vertical position is an aft position.

Preferably, the shelf member is a first shelf member, the apparatus further including at least a second shelf member mountable and dismountable to the frame member, the first and second shelf members dimensioned such that, when the first shelf member is in the vertical position and the couplers mounted to the second shelf member are within the clearance region, the clearance region forms a path such that as the second shelf member is moved vertically past the first shelf member, the first shelf member is outside a shelf path swept by the second shelf member.

The hanging coupler may also be operative with the upper fourth coupler to support the shelf member in a fore vertical position on a second side of the clearance region. The hanging coupler may also be operative with the lower third coupler to support the shelf member in a third vertical position on the first side of the clearance region and may also be operative with the lower fourth coupler to support the shelf member in a fourth vertical position on the second side of the clearance region.

The apparatus may further include a hanging delineator which forms a hanging surface and a hanging pin, one of the hanging surface and hanging pin linked to the shelf member and the other of the hanging surface and hanging pin linked to the frame member, when the shelf member is mounted to the frame member, the hanging surface and hanging pin essentially parallel to the axis and within the coupling plane and, wherein, the hanging delineator and hanging pin are operative to mount the shelf member in an essentially vertical position, with the shelf member in the vertical position and the hanging pin received on the hanging surface, the shelf member supported in the vertical position.

The shelf member may be a first shelf member, the apparatus further including a second shelf member and the hanging surface and the hanging pin may be positioned such that when the first shelf is supported in the vertical position, the second shelf may be supported in the horizontal position by the second coupler pair.

In a preferred embodiment he frame member includes a rear end and a fore end, the shelf member include first and second oppositely facing surfaces, the vertical position is a first vertical position wherein the first surface faces the fore end and, wherein, the hanging surface and the hanging pin are also operative to support the shelf member in a second vertical position wherein the second surface faces the fore end.

In one aspect the shelf member includes oppositely facing first and second surfaces, in first position the first surface faces upwardly and, wherein, the couplers are also operative to mount the shelf member to the frame member in a second position wherein the second surface faces upwardly, to this end, the first and second delineators form third and fourth pin support surfaces which face in directions opposite the first and second pin support surfaces, respectively, when in the second position, the first and second pins received on the third and fourth support surfaces, respectively.

Preferably the shelf member includes fore and aft oppositely facing edges and, the first and second couplers are mounted to the end surface adjacent the fore edge.

The apparatus may include a plurality of second coupler pairs vertically spaced below the third and fourth couplers, each second coupler pair operative in conjunction with the first coupler pair to support the shelf member in a distinct position. Preferably the coupler pairs are equispaced along the frame member.

In another aspect one of the delineators is a pivot delineator which forms a pivot zone, the coupler in the same pair as the pivot delineator being a first non-pivot coupler, the pin which is received by the pivot delineator being a pivot pin and the coupler in the same pair as the pivot pin being a second non-pivot coupler, wherein, the pivot delineator and the first non-pivot coupler are spaced and the pivot pin and the second non-pivot coupler are spaced such that when the pivot pin is inside the zone, the shelf member is rotatable from the first position to an essentially vertical position about the pivot pin such that the non-pivot coupler on the frame member is outside a path swept by the non-pivot coupler on the shelf member.

In yet another aspect the shelf member includes a brace member and a wall member, the brace member including a base member and two lateral members extending in the same direction form opposite ends of the base member, the wall member traversing the distance between the lateral members, the brace member formed of a first material and the wall member formed of a second material, the first material being more rigid than the second material, the first and second couplers mounted to the brace member.

Preferably, the frame member is a first frame member, the apparatus further includes a second frame member which forms a second essentially vertical frame surface, a second coupling plane parallel to the second frame surface, the end surface is a first end surface and the shelf member forms a second end surface, the first and second end surfaces facing in opposite directions. In this embodiment, the apparatus further includes a third coupler pair including fifth and sixth couplers connected to the second end surface and a fourth coupler pair including seventh and eighth couplers connected to the second frame member, the fourth pair delineating a second clearance region within the second coupling plane, the couplers including third and fourth pins and third and fourth slot delineators, the third and fourth delineators defining third and fourth pin support surfaces, respectively. The third and fourth delineators form third and fourth passageways from the third and fourth support surfaces, respectively, each passageway wide enough for one of the pins to pass through. When the shelf member is mounted to the brace members, the pins essentially parallel to the axis, each of the third and fourth passageways defining third and fourth paths which are essentially perpendicular to the axis, are within the second coupling plane and which open into the second clearance region. When the shelf member is mounted to the frame members in the first position, the third and fourth pins are received on the third and fourth support surfaces, respectively, the third and fourth paths are essentially perpendicular to the axis, within the second coupling plane and opening into the second clearance region so that the shelf member is dismountable from the frame member by moving the shelf member perpendicular to the axis such that the third and fourth pins pass through the third and fourth paths and the fifth and sixth couplers pass into the second clearance region.

In another aspect the first and third coupler pairs form a shelf dimension and at least a portion of the first clearance region and a section of the seventh coupler closest to the portion form an egress dimension wherein the egress dimension is greater than the shelf dimension. In one embodiment the first clearance region forms a recess which is large enough to receive the first coupler pair and extends opposite the second frame member and wherein the portion is formed within the recess.

In another embodiment the first frame member forms a lateral opening in the first clearance region, the lateral opening having dimensions which are greater than the dimensions of the shelf member.

In yet another embodiment the first and third coupler pairs form a shelf dimension and each of the fourth and eighth frame members forms an opening large enough for the first and third coupler pairs to pass through, respectively, to dismount the shelf.

In another aspect the frame member includes a front end and a rear end, the third and fourth couplers are front third and fourth couplers connected to the front end and the apparatus further includes rear third and fourth couplers connected to the rear end to selectively link and de-link the shelf member to the rear end in another position wherein the shelf member is precluded from downward movement.

Preferably, a storage space separates the front and rear ends. Also, preferably, the apparatus further includes first and second spaced wall members separated by the storage space, and the first and second walls form an elongate storage tunnel and wherein the apparatus further includes an end closure mounted for movement with respect to the frame member, thereby permitting the storage tunnel to be opened and closed.

In one other preferred embodiment the third coupler is a first third coupler and the apparatus further includes a second third coupler which is vertically spaced with respect to the first third coupler. In this embodiment, the first, second and fourth couplers and the first third coupler are juxtaposed such that the couplers can support the shelf member in a second position which is different than the first position.

In one embodiment, the first third coupler forms the first support surface and the second third coupler forms another support surface, the fourth coupler forms the second support surface and the first and second couplers are pins. When the shelf member is in the second position, one of the pins bears against the second support surface and the other of the pins bears against the another support surface. Preferably there are several third couplers vertically spaced with respect to the first third coupler and any of at least a subset of the third couplers may cooperate with the first, second and fourth couplers to support the shelf member in an angled position.

The invention further includes a support apparatus for use with a rigid frame member, the apparatus including a coupler pair including forward and rearward couplers mounted to the frame member, a shelf assembly including a shelf member having a planar surface, a longitudinal axis and an end surface coincident with the axis, a first coupler mounted to the end surface and cooperating with one of the forward and rearward couplers to mount the shelf member to the frame member for rotation about a first rotation axis and a support assembly including a support member having an end surface and a second coupler mounted to the end surface, the second coupler cooperating with the other of the forward and rearward couplers to mount the support member to the frame member for rotation about a second rotation axis, the support member also having at least first and second support surfaces which are essentially parallel to the second rotation axis, the first support surface being a first distance from the second rotation axis and the second support surface being a second distance from the second rotation axis wherein the first and second distances are different. In this embodiment, with the support member and the shelf member mounted to the frame member, the support member can support the shelf member in a first position wherein the planar surface is supported by the first support surface and in a second position wherein the planar surface is supported by the second support surface.

Other details of the invention are set forth in the following detailed description and in the drawings.

BRIEF DESCRIPTIONS OF THE DRAWINGS

FIG. 1 is a perspective view of a store fixture with shelves erected for product display, with both end closures closed and with a sign board in the lowered position;

FIG. 2 is a perspective view of a store fixture generally like that of FIG. 1 but with an end closure open, the sign board in the raised position and with hang bar supports and mounting brackets installed in place of shelves;

Figure 3:
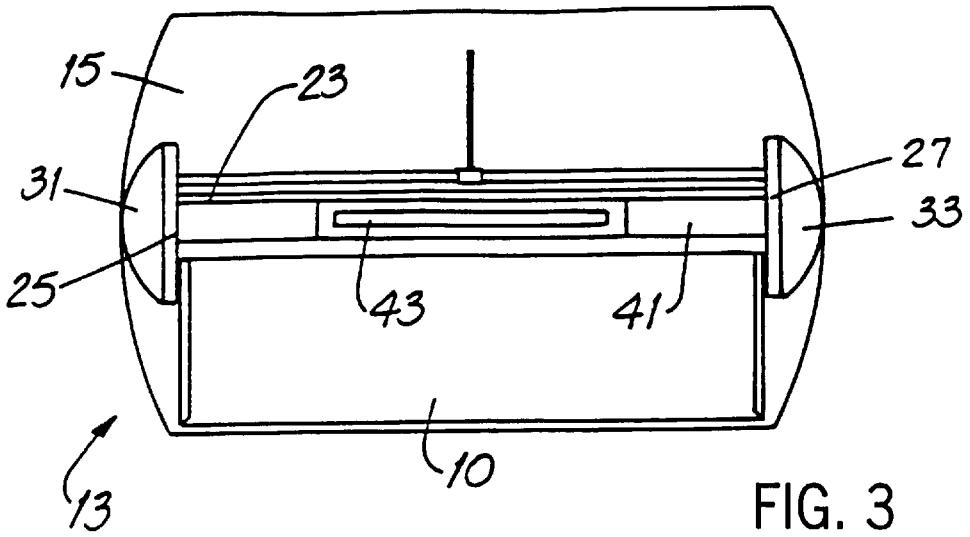
FIG. 3 is a top plan view of the store fixture of FIG. 1.
Figure 4:
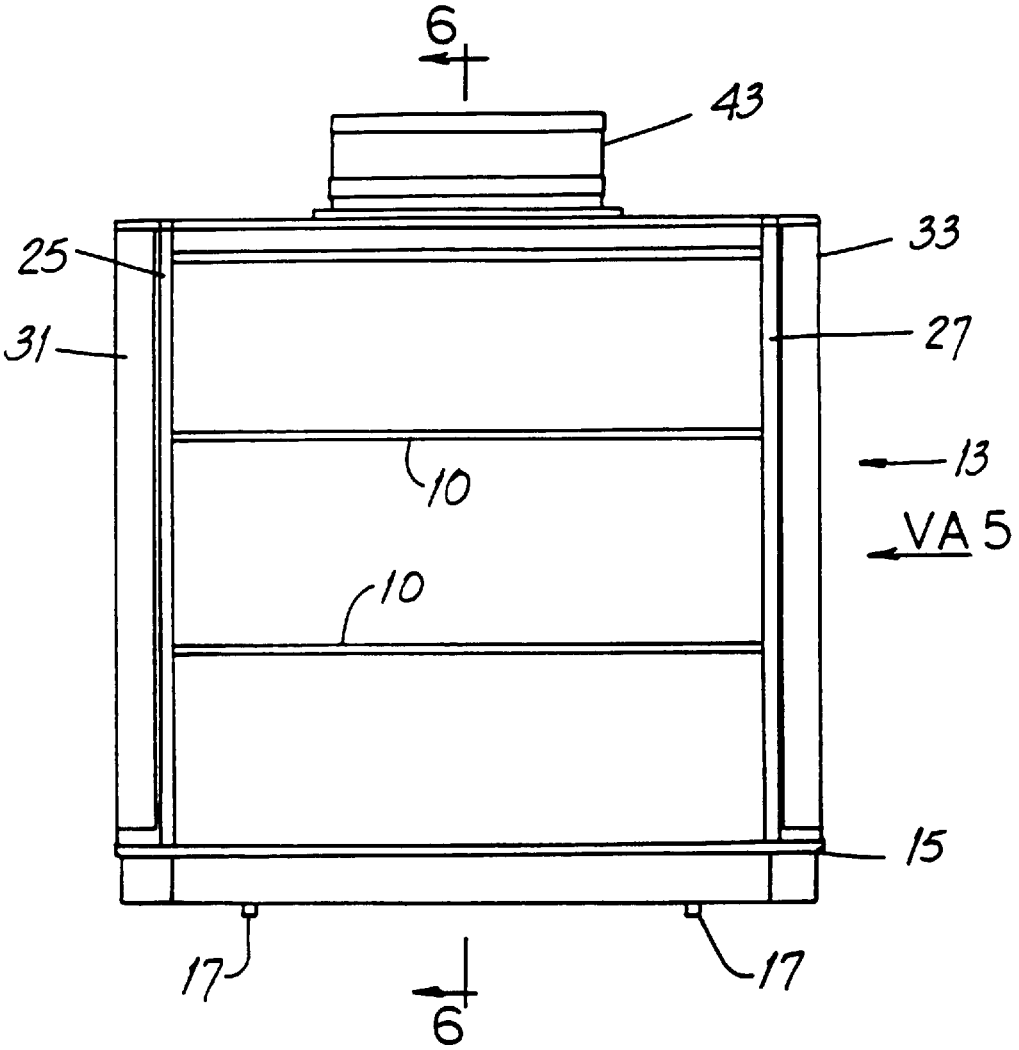
FIG. 4 is a front elevation view of the store fixture of FIG. 1 with the sign board raised.
Figure 6:
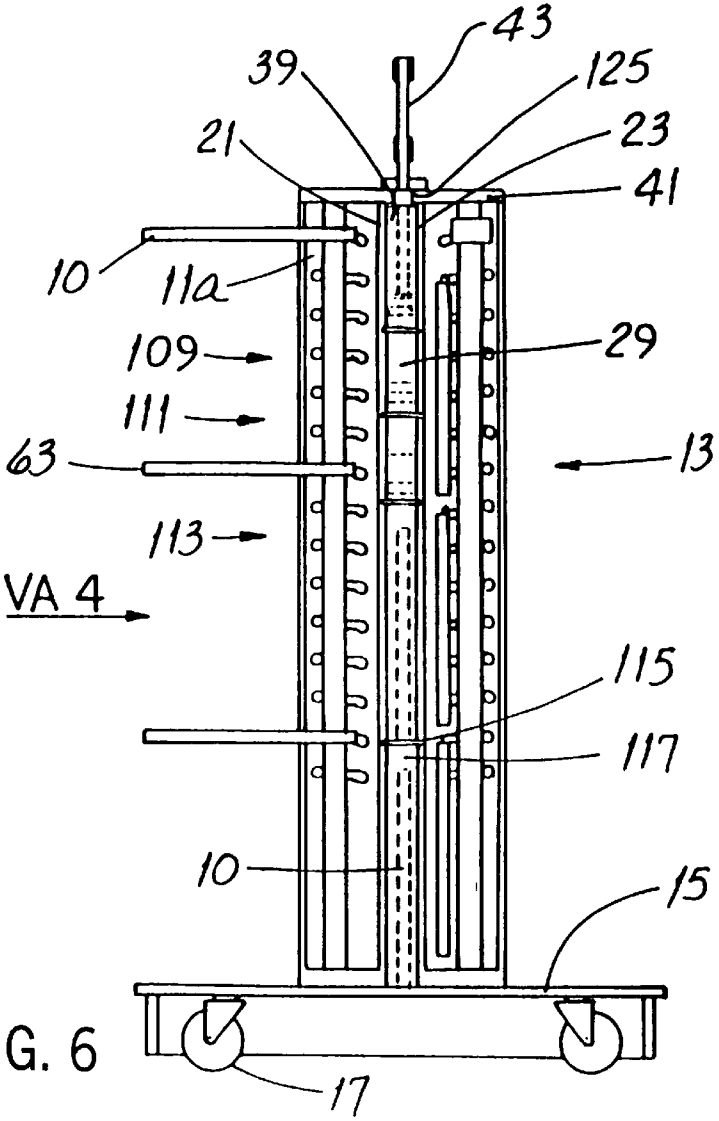
FIG. 6 is a sectional view of the store fixture of FIG. 4 taken along the viewing plane 6—6 thereof.
Figure 5:
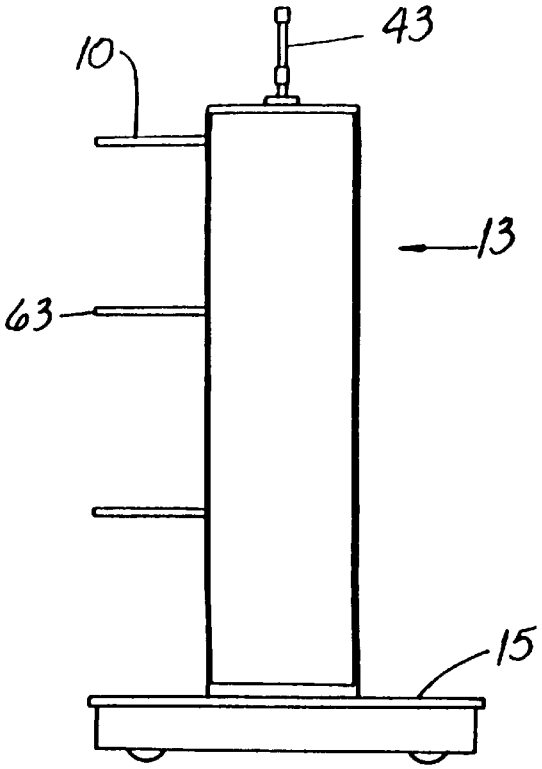
FIG. 5 is an end elevation view of the store fixture of FIG. 4 taken along the viewing axis VA5 thereof.
Figure 7A:
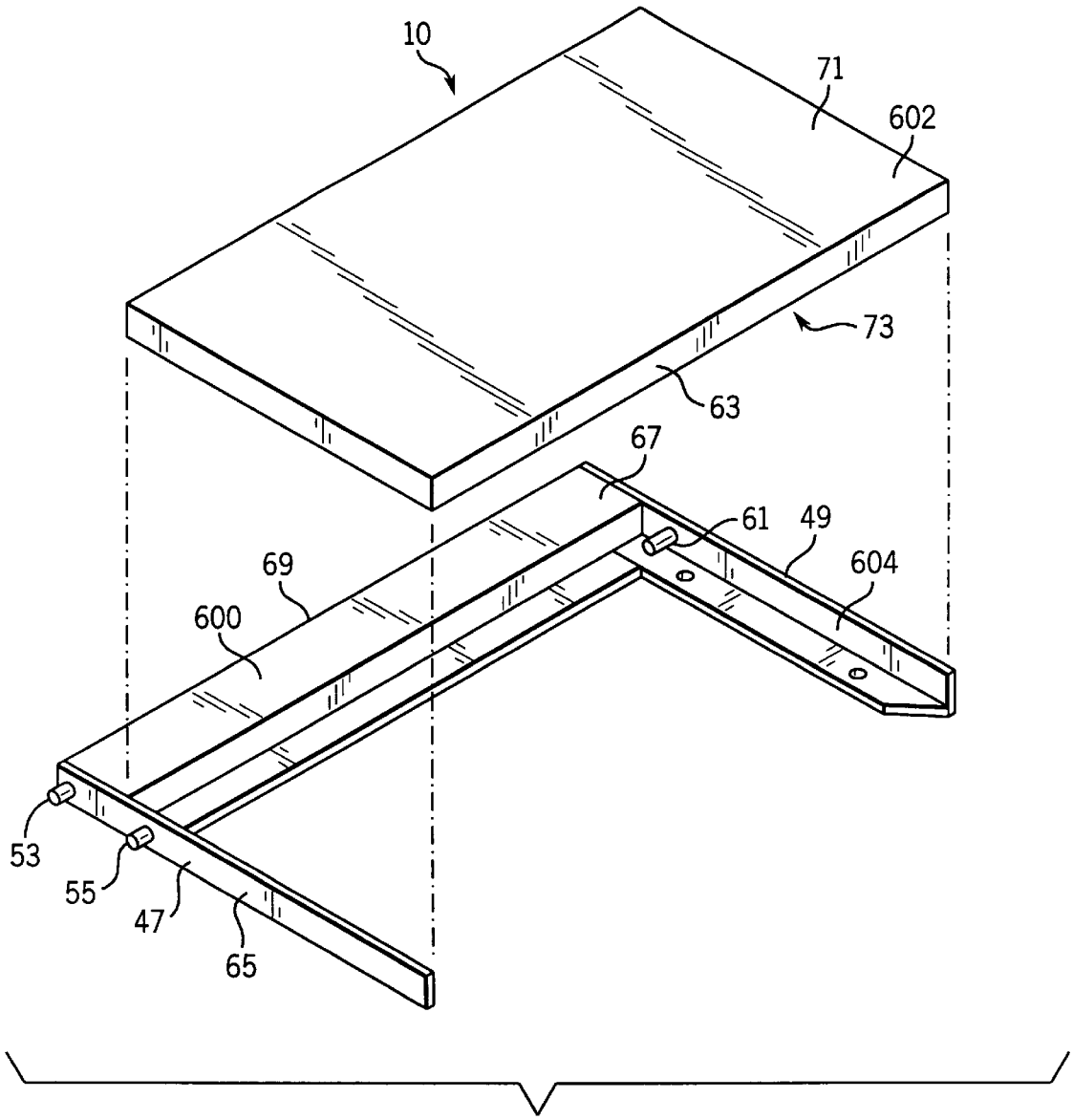
Figure 12:
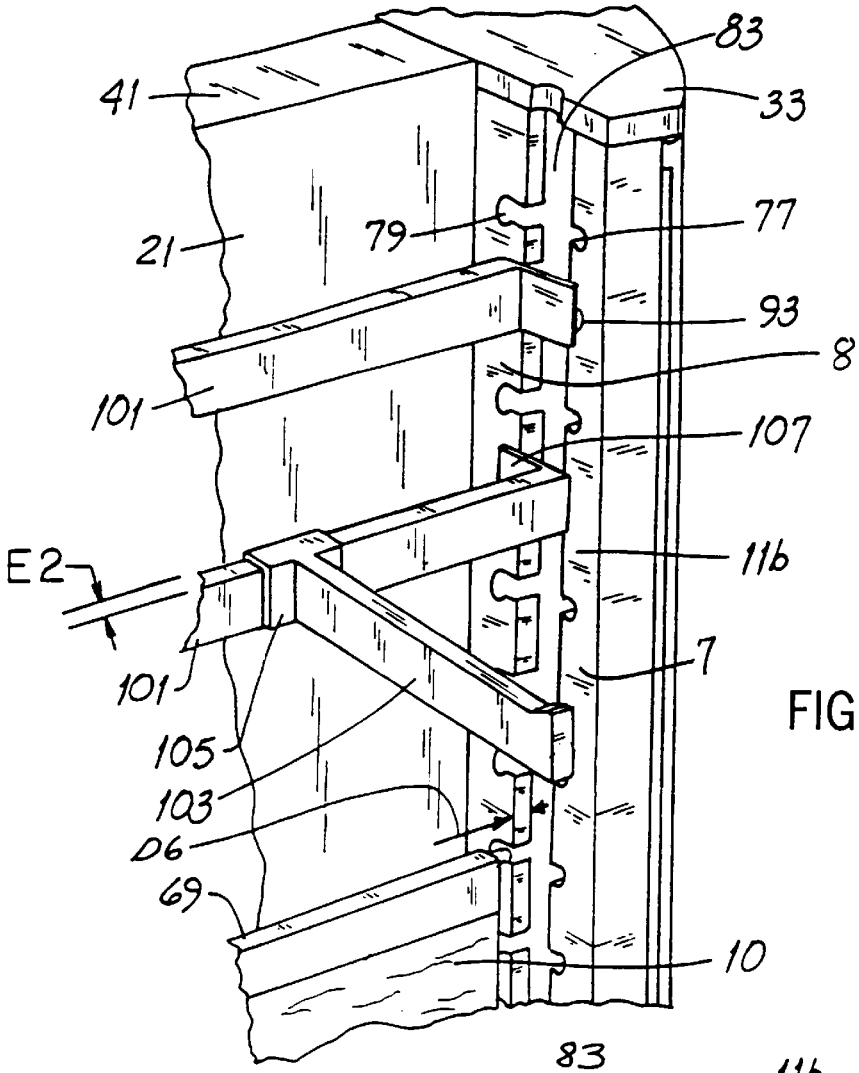
Figure 13:
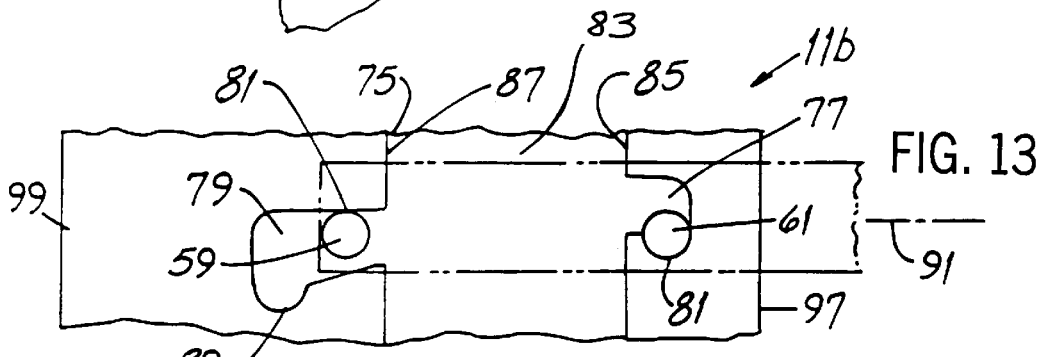
Figure 16:
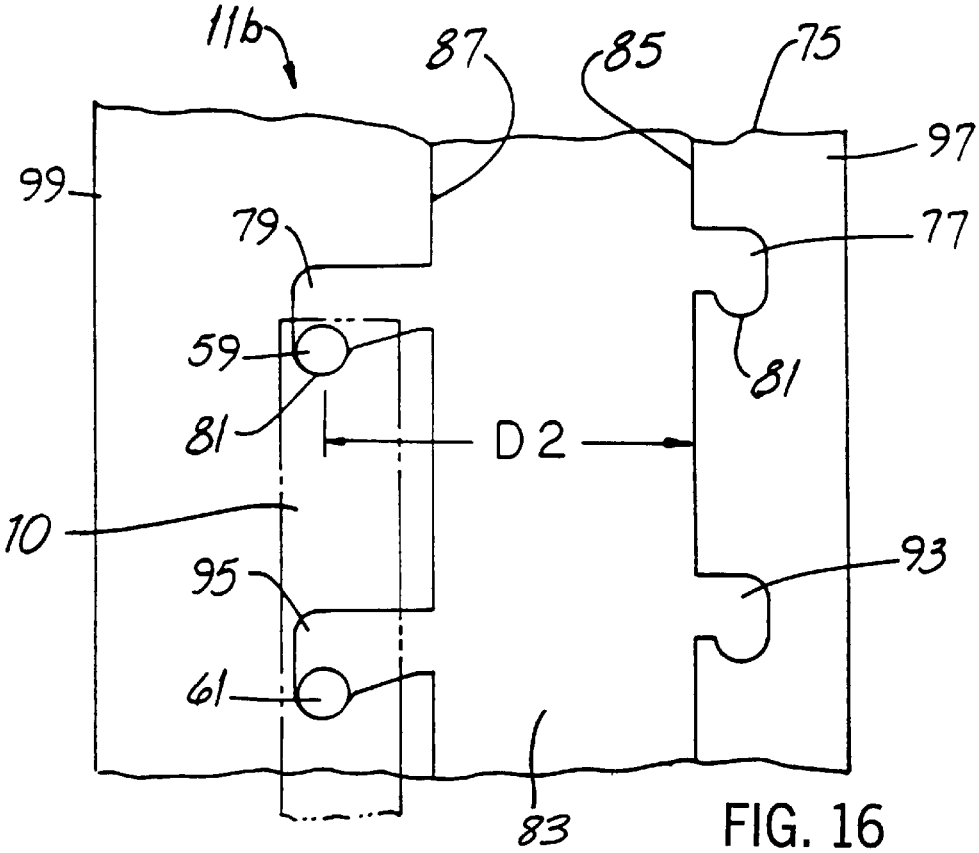
Figure 19A:
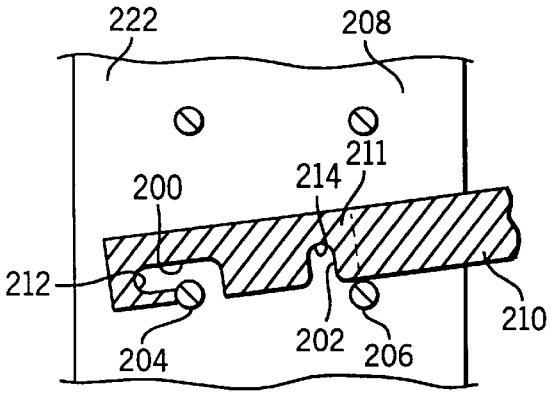
Figure 19B:
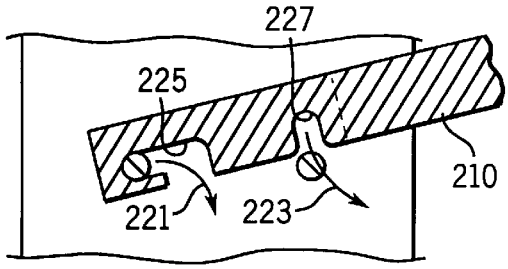
Figure 19C:
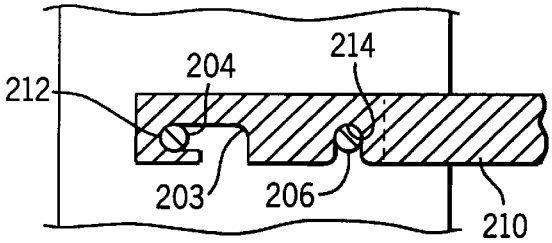
Figure 19D:
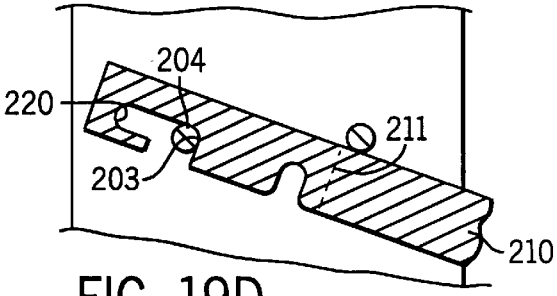
Figure 19E:
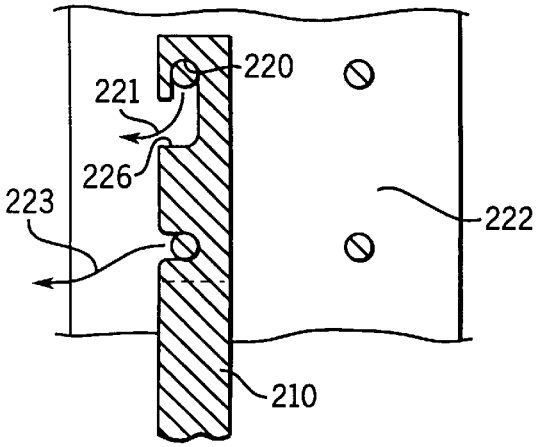
Figure 20:
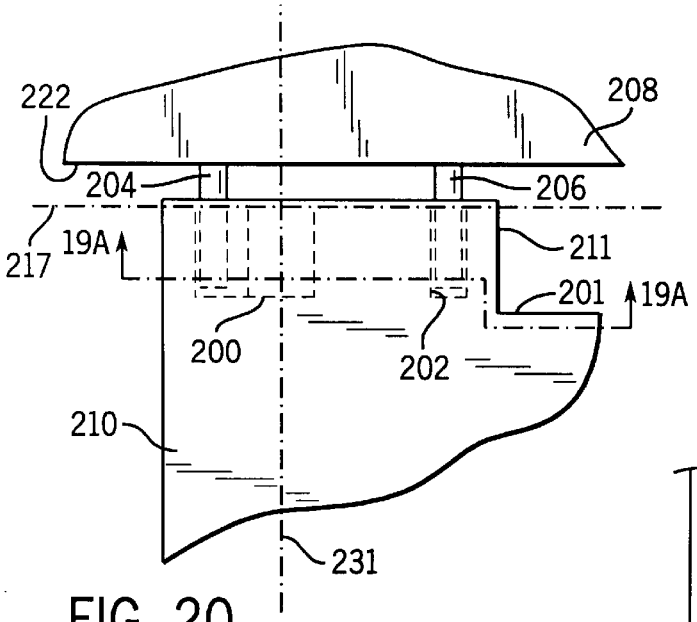
Figure 21:
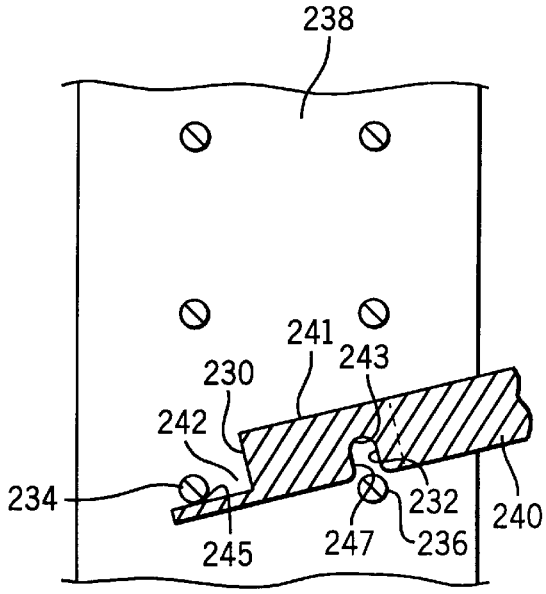
Figure 22:
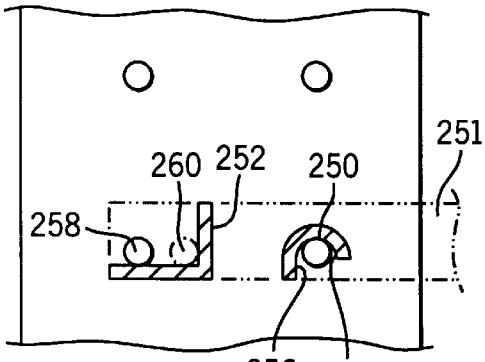
Figure 23:
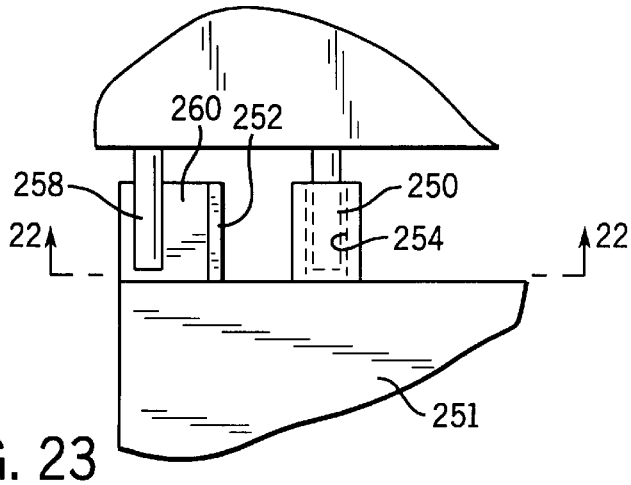
Figure 31:
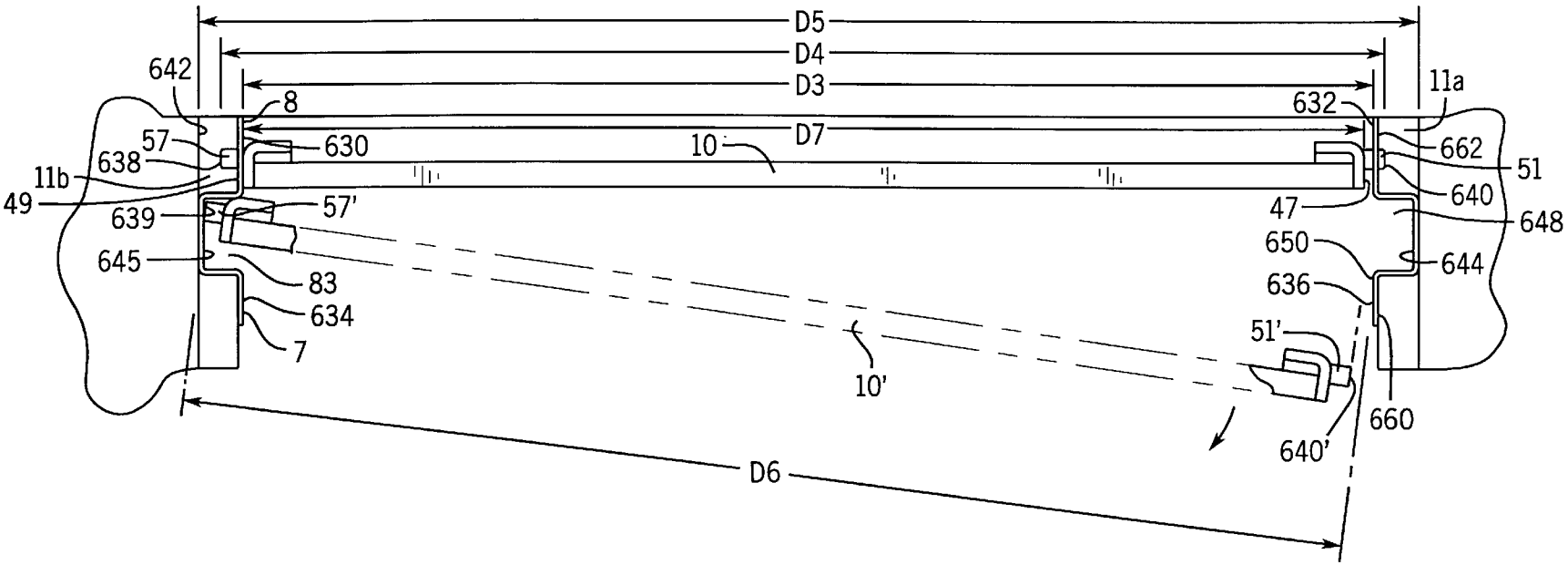
Figure 35:
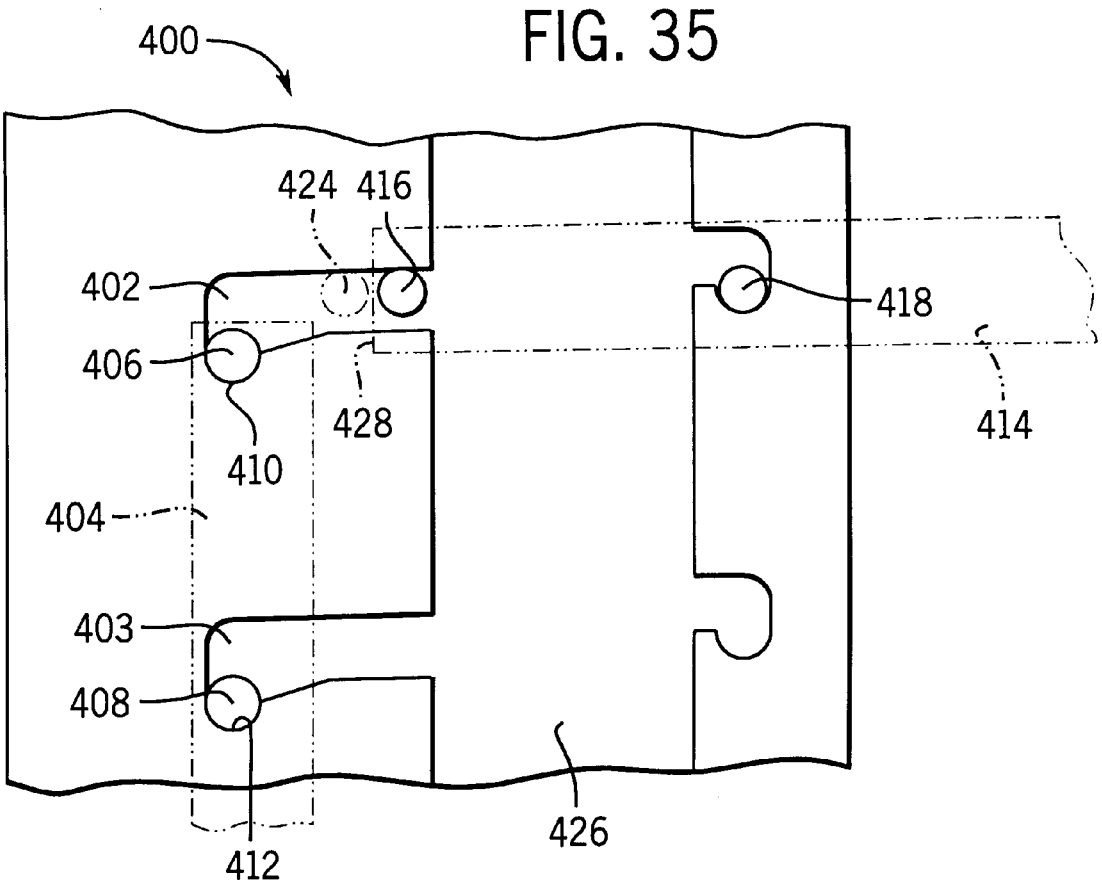
Figure 36:
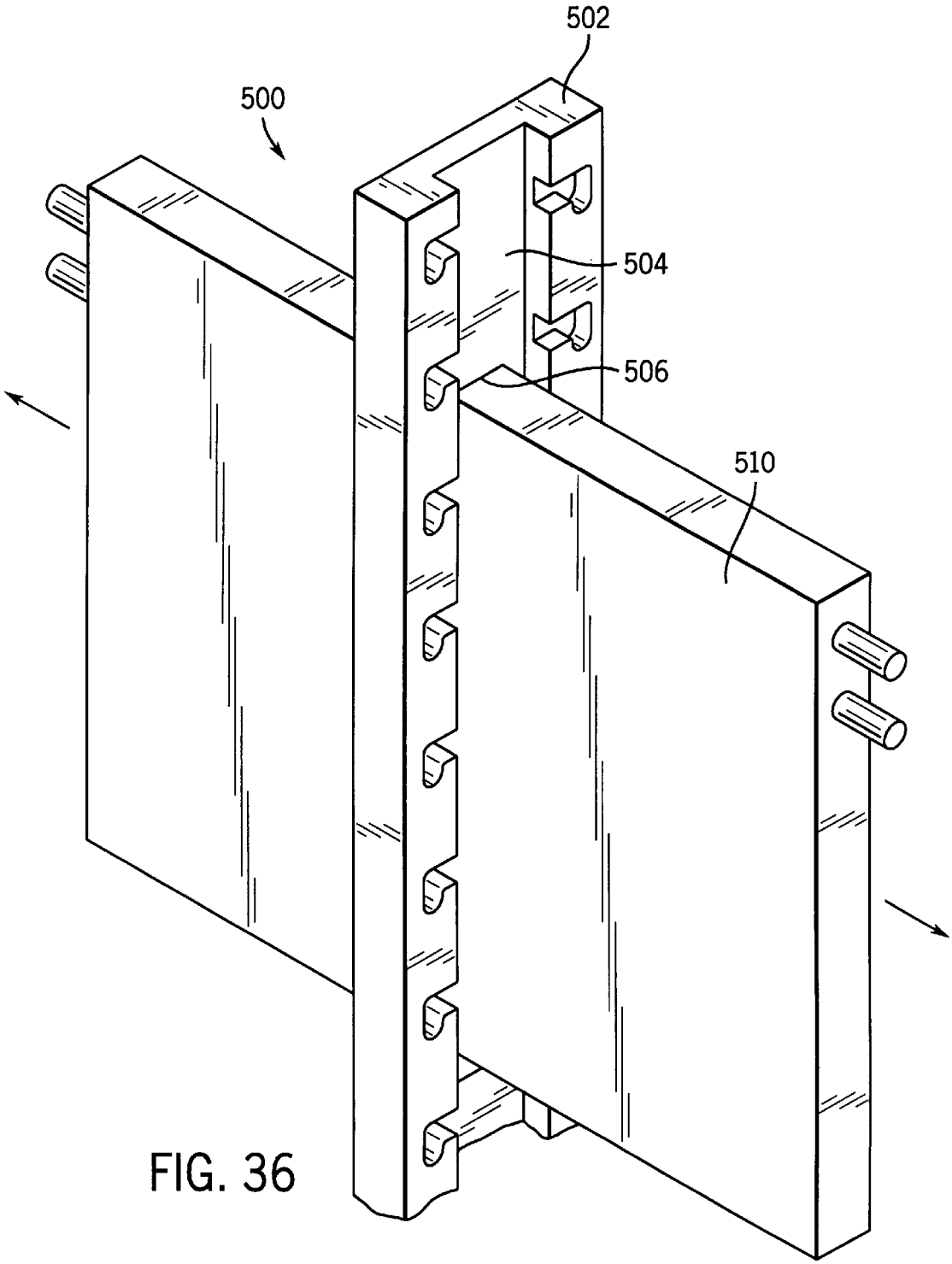
Figure 41:
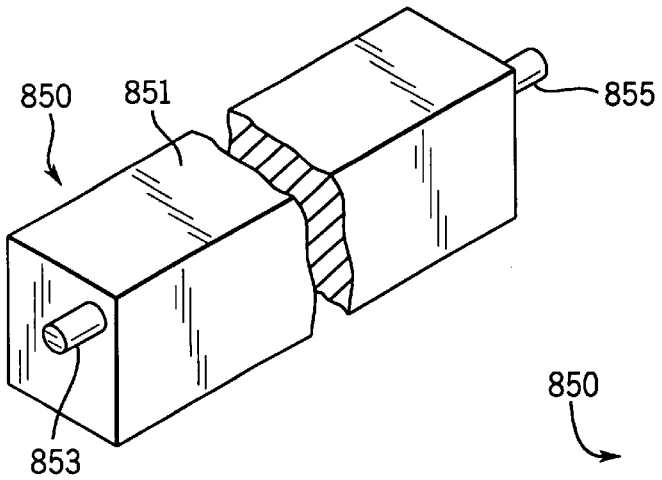
Figure 42:
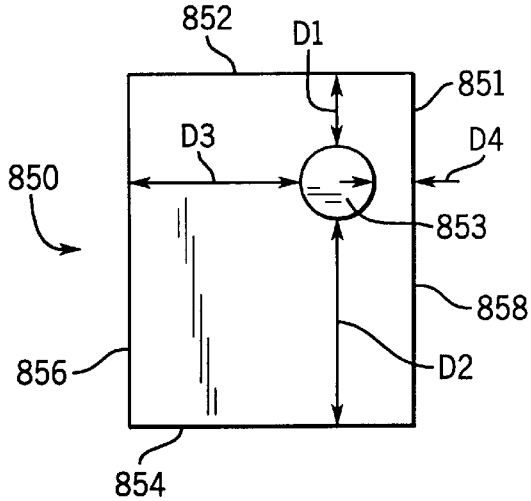
Figure 43:
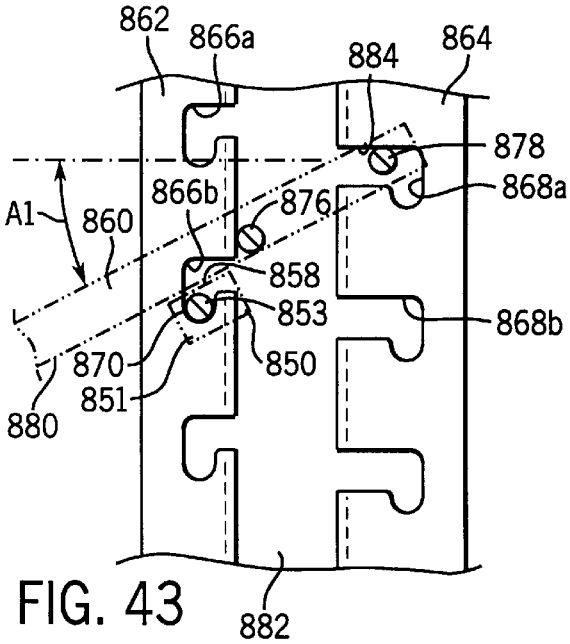
Figure 44:
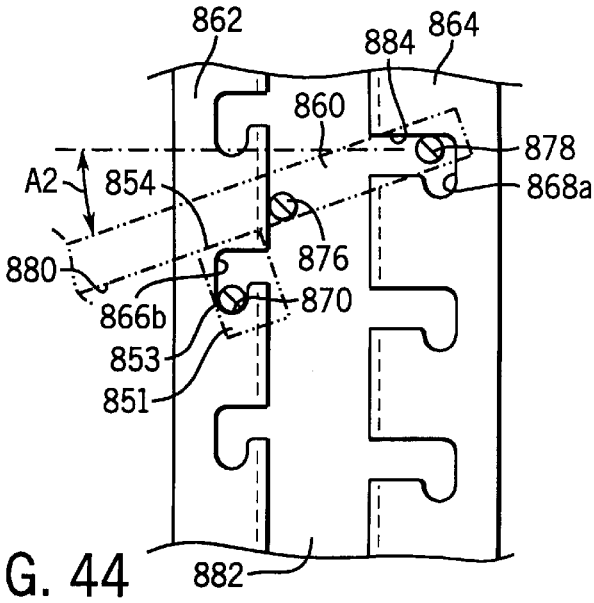
Figure 45:
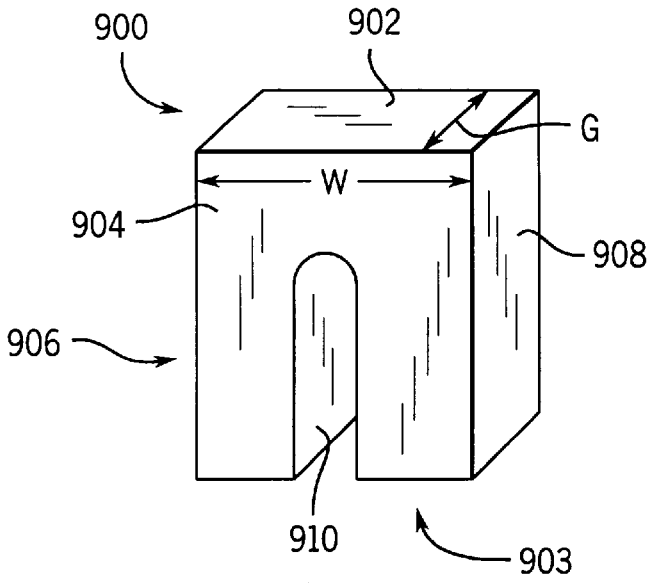

FIGS. 7, 7*a* are perspective views of a shelf used in the store fixture of FIGS. 1 through 6. Parts are broken away;

FIG. 8 is an end view of the shelf of FIGS. 7 and 10 taken along the viewing axis VA8 of FIG. 10. Parts are broken away;

FIG. 9 is a top plan view of a portion of a metal edge member used in the shelf of FIG. 7. Parts are broken away;

FIG. 10 is a top plan view of the shelf of FIG. 7;

FIG. 11 is a section view of the shelf of FIG. 10 taken along the viewing plane 11—11 thereof;

FIG. 12 is a perspective view of a portion of the store fixture. Parts are broken away;

FIGS. 13, 14, 15 and 16 show, in solid outline, one of the two shelf support apparatus used in the store fixture. Sequential positions of a shelf are shown in dashed outline in such Figs;

FIG. 17 is a downwardly looking section view of one of the store fixture end closures;

FIG. 18 shows, in dashed outline, another embodiment of a support apparatus having slot locations differing from the slot locations shown in, e.g., FIGS. 13–16. Another embodiment of a shelf and two of its support pins are shown in solid outline and parts of the shelf are broken away;

FIGS. 19A–19E illustrate a second embodiment of the present invention wherein a shelf member is in several different positions with respect to a frame member, the views taken along the line 19A—19A of FIG. 20;

FIG. 20 is a top plan view of a shelf/frame member coupling assembly;

FIG. 21 is an illustration similar to that of FIG. 19B, albeit of a third embodiment of the present invention;

FIG. 22 is an illustration similar to that of FIG. 19C, albeit of a fourth embodiment of the present invention which is taken along the line 22—22 of FIG. 23;

FIG. 23 is a top plan view similar to the view of FIG. 20;

FIG. 24 is a view of a fifth embodiment of the present invention which is similar to the view of FIG. 22;

FIG. 25 is a schematic diagram of a sixth preferred embodiment of the present invention with a shelf member in a first horizontal position;

FIG. 26 is similar to FIG. 25, albeit with the shelf member positioned in a second horizontal position;

FIG. 27 is similar to FIG. 26, albeit with the shelf member in an aft downward vertical position;

FIG. 28 is similar to FIG. 27, albeit with the shelf member in a fore downward vertical position;

FIG. 29 is similar to FIG. 27, albeit with the shelf member in an aft upward vertical position;

FIG. 30 is similar to FIG. 29, albeit with the shelf member in a fore upward vertical position;

FIG. 31 is a top plan view of an inventive shelving assembly;

FIG. 32 is a front plan view of a second embodiment of the inventive shelving assembly;

FIG. 33 is a plan view of a third embodiment of the inventive assembly;

FIG. 34 is a fourth embodiment of the inventive assembly;

FIG. 35 is a view similar to the view of FIG. 16, albeit of another embodiment of the invention;

FIG. 36 is a perspective view of yet another embodiment of the present invention;

FIG. 37 is a view of yet another embodiment similar to the view of FIG. 13 with a shelf illustrated in a horizontal supported position;

FIG. 38 is similar to FIG. 37, albeit with the shelf supported in a first angled position;

FIG. 39 is similar to FIG. 38, albeit with the shelf supported in a second angled position;

FIG. 40 is similar to FIG. 38, albeit with the shelf supported in yet another angled position;

FIG. 41 is a perspective view of a support bar assembly according to the present invention;

FIG. 42 is an end view of the assembly of FIG. 41;

FIG. 43 is a view similar to the view of FIG. 13, albeit illustrating the support bar of FIG. 41 supporting a shelf in a first angled position;

FIG. 44 is similar to FIG. 43, albeit with the bar assembly supporting a shelf in a second angled position;

FIG. 45 is a perspective view of an angle support; and

Figure 46:
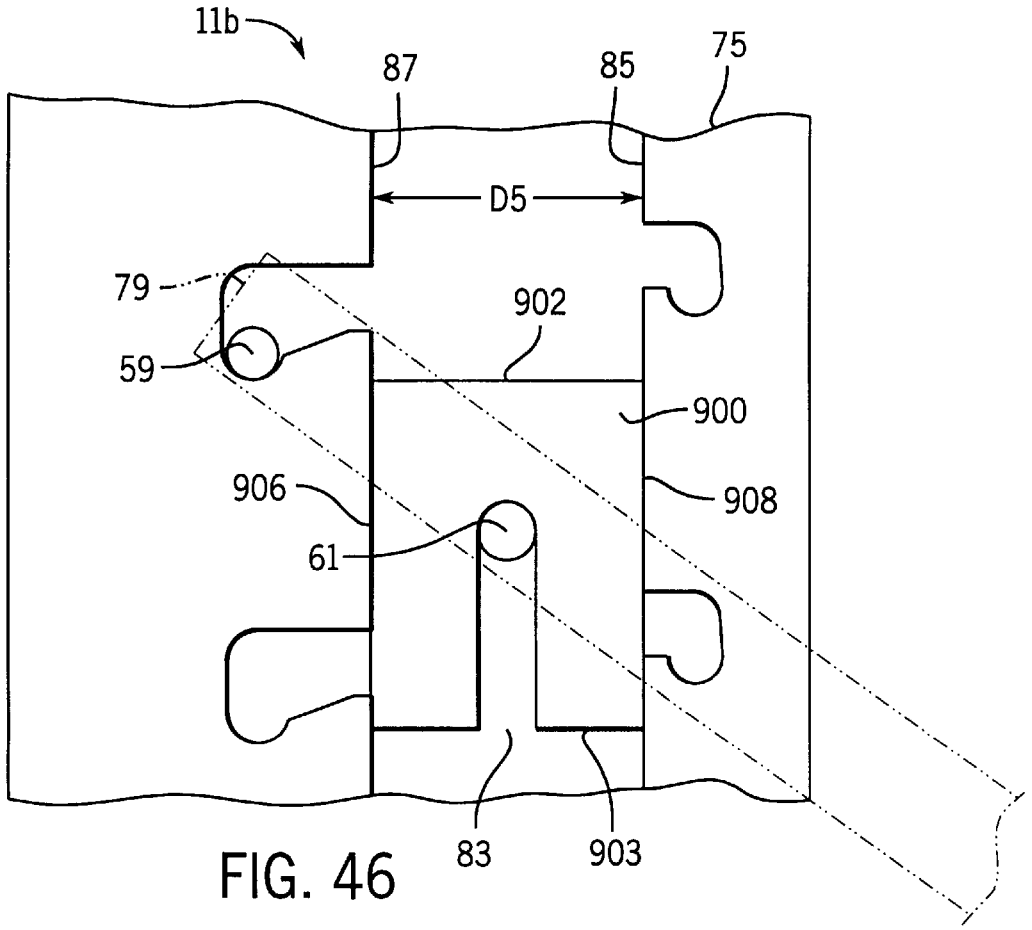

FIG. 46 is a view similar to the view of FIG. 16, albeit with the support of FIG. 45 supporting a shelf in an angled position.

DETAILED DESCRIPTIONS OF PREFERRED EMBODIMENTS

Referring first to FIGS. 1 through 10, aspects of the invention involve a shelf 10 (i.e. a shelf member which is also generically referred to herein as a "brace member") and apparatus 11 for supporting the shelf 10 at each brace member or shelf end surface. The invention will be described in connection with an embodiment involving a store fixture 13. The overall arrangement of the fixture 13 will be described first and this is followed by more detailed descriptions of specific features.

The fixture 13, shown in FIGS. 1 through 6, includes a generally planar base 15 optionally equipped with casters 17 for easy relocation from place to place. A frame 19 (i.e. a frame member) is rigidly affixed to and extends vertically upwardly from the base 15. The frame 19 includes substantially flat first and second wall members 21 and 23, respectively. While a single wall member may be used, two spaced-apart wall members are preferred for reasons that will become apparent.

The frame 19 also includes lateral support members configured as first and second end stanchions 25 and 27, respectively. Each of the wall members 21, 23 extends between and is rigidly affixed to the stanchions 25, 27.

Conveniently, the fixture 13 has a storage section 29 which, when considered from left to right, is between the stanchions 25, 27. Considered from front to rear, such section 29 is between the wall members 21, 23.

At least for reasons of better aesthetics, the storage section 29 is covered by first and second end closures 31, 33, respectively. Most preferably, such closures 31, 33 are pivot mounted to the first and second end stanchions 25, 27, respectively, and swing open and closed along vertical axes 35, 37, respectively. The end closures 31, 33 are preferably configured to include backlighting and/or some sort of graphic treatment as a sales aid, both as further described below.

The spaced wall members 21, 23 define a vertically oriented gap 39 between them and an aesthetically pleasing closure member 41 is atop the gap 39 for gap closure . The fixture 13 has a sign board 43 mounted for vertical movement with respect to the closure member 41, thereby configuring the sign board 43 to be pulled upwardly and displayed above the closure member as shown in FIG. 2 or depressed downwardly and received in the gap 39 for storage as shown in FIG. 1. Details of the shelf 10 and shelf support apparatus 11 will now be set forth.

Referring to FIGS. 7 through 11 and 7A, the shelf 10 has a longitudinal axis 45 and first and second substantially flat end surfaces 47, 49, respectively, which are coincident with axis 45 and perpendicular thereto. In addition, shelf 10 forms fore and aft oppositely facing edges 63, 69, respectively. Shelf 10 has a first pair 51 of support pins, (i.e., pins 53 and 55) (also referred to as first and second couplers forming a first coupler pair), extending from the first end surface 47. Similarly, shelf 10 has a second pair 57 of support pins, (i.e., pins 59 and 61) (also referred to as fifth and sixth couplers forming a third coupler pair), extending from the second end surface 49. As to those pins comprising one of the pairs, (e.g., pair 51 including pins 53 and 55), such pins are also referred to herein as first and second pins 55, 53, respectively. (As to a particular pair 51 or 57, the pin 55 or 61 closer to the shelf outward or fore edge 63 is identified as the first pin.) The pins 53, 55, 59, 61 extend in directions parallel to the axis 45 and as to those pins comprising the first or third pair, (e.g., pins 53 and 55), such pins define a first spacing dimension D1.

Referring particularly to FIGS. 7, 7A, 8, 9 and 11, a highly preferred shelf 10 includes a U-shaped brace member 600 and a wall member 602. Brace member 600 includes a base member 67 and two lateral members 65, 604 which extend in the same direction from opposite base member 67 ends.

Wall member 602 traverses the distance between lateral members 65, 604 and includes a top or first surface 71 and an oppositely facing bottom or second surface 73. Wall member 602 and brace member 600 are fastened together in any manner (e.g. glue, mechanically or by any other means well known in the art). Preferably brace member 600 is formed of a strong rigid material (e.g. steel, aluminum, etc.) while wall member 602 is formed of a lightweight relatively strong material (e.g. particle board, wood laminate, etc.). This construction provides an extremely strong shelf 10 which is relatively light weight and inexpensive to produce.

Each pair of pins (e.g. pair 51) is integral with one of the metal edge members 65 or 604. The end surfaces 47, 49 are those of respective edge members 65, 604. Stiffener or base member 67 extends along an aft edge 69 (opposite fore edge 63) of shelf 10 which is rearward when the shelf 10 is erected for product display. As shown in FIG. 8, the stiffener or base member 67 defines an edge dimension E1 and the significance of such dimension E1 is further described below.

Considering FIGS. 8 and 10, it is apparent that as to a particular pair 57 of pins, (e.g., the pins 59 and 61), the shelf edge 69 is tangent to the second pin 59 and both pins 59, 61 are spaced equidistant from the shelf top surface 71 or bottom surface 73. This specific configuration is preferred for reasons relating to manufacturing expediency. However, as further described below, other pin locations are possible without departing from the spirit of the invention.

Figure 14:
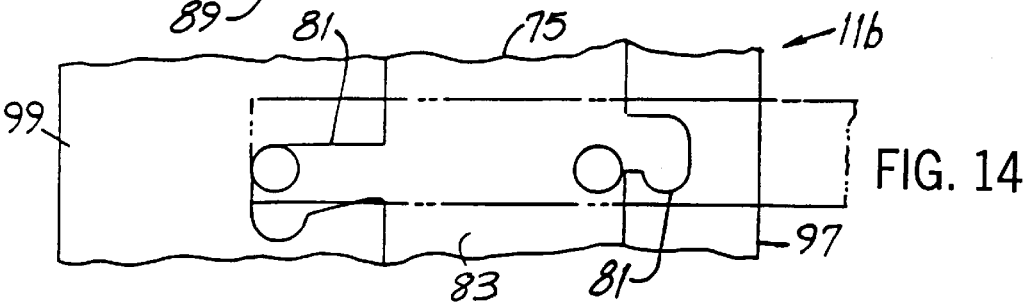

Referring next to FIGS. 6 and 12 through 16, the invention also involves a separate apparatus 11*a*, 11*b* for supporting the shelf at each end surface 47, 49. In the store fixture 13, the apparatuses 11*a*, 11*b* are mirror images of one another and are shown in FIGS. 6 and 12, respectively. Each apparatus 11*a* and 11*b* includes a front end 750 and a rear end 752, respectively (only shown with respect to apparatus 11*a* in FIG. 6). Therefore, it is necessary to describe only one of the apparatus 11*a* or 11*b* and the latter is described below. The apparatus 11*b* includes a frame or support member 75 having first and second slot delineators 7 and 8 (also referred to as second and third couplers forming a second coupler pair) which define slots 77 and 79, respectively. Referring also to FIGS. 13 and 14, each slot 77, 79 has a pin-support portion or surface 81. A rectangularly shaped, "channel-like" clearance region 83 is between such pin-support portions 81 and between the slots 77, 79. Clearance region 83 has first and second boundaries 85 and 87, respectively, and the second slot 79 includes a pivot portion or pivot zone 89. As shown in FIG. 16, such pivot portion 89 and the first boundary 85 define a second spacing dimension D2 slightly greater than the first spacing dimension D1.

Referring now to FIG. 31, shelf 10 is illustrated in an exemplary vertically mounted position where shelf 10 is supported by frame members 11*a* and 11*b*. Shelf 10 is also shown in phantom and identified as 10' in a dismounted position which facilitates shelf removal. Dismounted shelf 10' includes pin pairs 51' and 57' and a pin end 640'. Delineators 7 and 8 (i.e. the second coupler pair) extend from a first vertical surface 642 on opposite sides of clearance region 83, each delineator 7, 8 forming a delineator edge 634, 630, respectively, which is essentially parallel to surface 642. Similar delineators 660 and 662 (also referred to herein as seventh and eighth couplers forming a fourth coupler pair) extend from a second vertical surface 644 on opposite sides of a clearance region 648, each delineator 660, 662 forming a delineator edge 636, 632, respectively, which is essentially parallel to surface 644.

FIG. 31 is a top plan view and shelf 10 is illustrated in a vertically hanging position and therefore the first coupler pair 51 (i.e. pins 53 and 55) appears as a single pin while the third coupler pair 57 (i.e. pins 59 and 61) also appears as a single pin. Ends of pairs 51 and 57 are identified by numerals 640 and 638, respectively.

Several important relative space dimensions are illustrated in FIG. 31. A third dimension D3 is the distance between facing delineator edges 630 and 632 or 634 and 636. A fourth or "shelf" dimension is the distance between pin ends 638 and 640. A fifth dimension is the distance between facing first and second vertical surfaces 642 and 644, respectively. A sixth or "egress" dimension is the distance between a portion 639 of the first clearance region 83 adjacent delineator 8 and a coupler edge 650 wherein coupler edge 650 is the edge of delineator surface 636 which is closets to portion 639. A seventh dimension D7 is the width dimension of shelf 10 from edge 47 to edge 49.

Relations between dimensions D3 through D6 are as follows. First, dimension D7 must be less than dimension D3. When so dimensioned, when shelf 10 is stored in a vertical position, shelf 10 fits between delineator surfaces 630 and 632 outside the space between clearance regions 83 and 648.

Second, dimension D4 must be greater than dimension D3 and less than dimension D5. When so dimensioned, shelf 10 can be mounted with oppositely facing pins received in delineator slots for support purposes and is not impeded by vertical surfaces 642 and 644 from movement perpendicular to the longitudinal shelf axis (i.e. the shelf length in FIG. 31).

Third, the pin-to-pin shelf dimension D4 is less than dimension D6. When so dimensioned, shelf 10 can easily be removed from members 11*a* and 11*b* by placing pin pair 57 in clearance region 83 adjacent portion 639 and swinging the opposite end 640 of shelf 10 outwardly as illustrated (see phantom in FIG. 31). End 640' clears coupler edge 650 for removal. Although not necessary, similar dimensions may be provided between a portion of clearance region 648 and a coupler edge (not numbered) of delineator 7.

As to other aspects of the invention, the pin-support portion 81 of the first slot 77 is shaped to conform to the shape of the first support pin 61. In a specific embodiment, the pin-support portion 81 of the first slot 77 defines an arc of a circle and the first support pin 61 is circular in cross-section and has about the same radius of curvature as the portion 81 of such first slot 77.

The pivot portion 89 of the second slot 79 is arcuate as is the second pin 59. (Most preferably, the pin 59 is cylindrical.) In a highly preferred embodiment, the support member 75 is vertical and when the first and second support pins 61, 59 are in registry with the pin-support portions 81 of the first and second slots 77, 79, respectively, the shelf 10 extends along a substantially horizontal plane 91.

Figure 15:
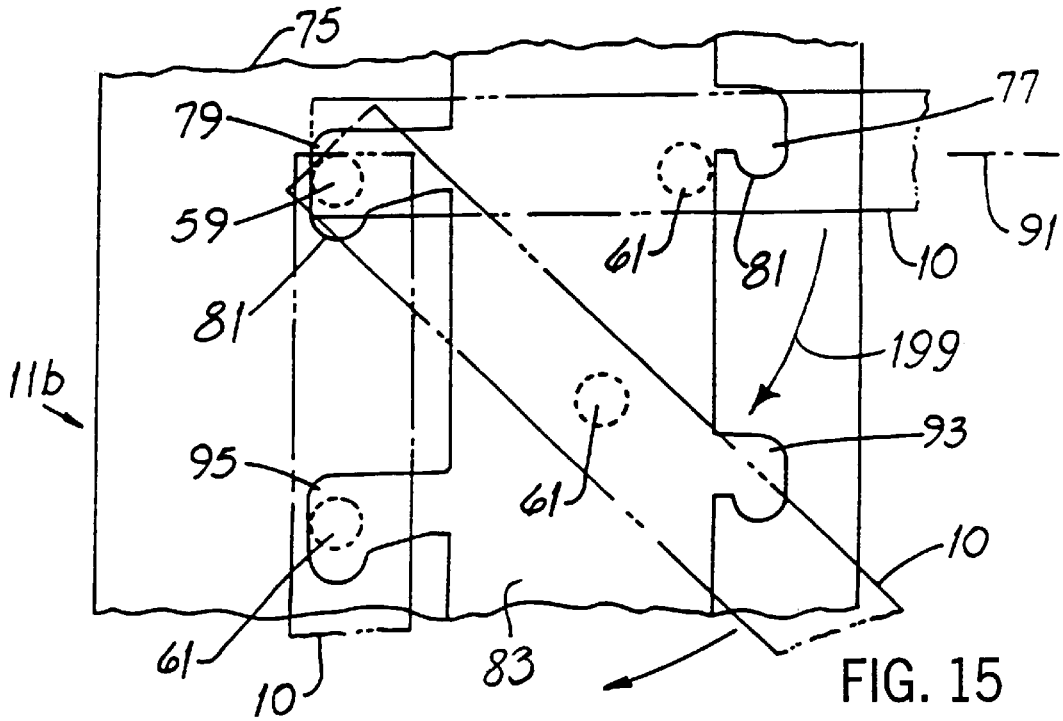

Considering FIGS. 13 through 16, and particularly FIGS. 13 and 15, when the second support pin 59 is in registry with the pivot portion 81 of the second slot 79 and when the shelf 10 is being pivoted downwardly for shelf storage or pivoted upwardly for product display, the shelf 10 is angled with respect to the horizontal plane 91. When such second support pin 59 is in registry with the pivot portion 81 of the second slot 79 and the shelf 10 is angled with respect to the horizontal plane 91 as shown in FIGS. 15 and 16, the first support pin 61 is spaced below the pin-support portion 81 of the first slot 77.

Referring to FIGS. 12, 15 and 16, a specific embodiment is suitable for self-storing shelves 10 on the support member 75. In such embodiment, the apparatus 11*b* has a lower third slot 93 (i.e., a lower third coupler) spaced below the first slot 77 (i.e., an upper third coupler) and a fourth slot 95 (i.e., a lower fourth coupler) spaced below the second slot 79 (i.e., an upper fourth coupler). When the second support pin 59 is in registry with the pivot portion 81 of slot 79 and shelf 10 is angled with respect to the horizontal plane, e.g., perpendicular to such plane 91, first support pin 61 is in fourth slot 95. To describe this configuration in less geometric terms, the first support pin 61 aligns with and swings through a shelf path 199 (see FIG. 15) and "swings into" the fourth slot 95 and the shelf 10 is reoriented from horizontal to a self-storing vertical position. To describe it in yet other terms, the pins 59, 61 are in the slots 79, 95, respectively, and the shelf 10 "hangs" vertically from the pins 59, 61 (as well as, of course, from the pins 53, 55.)

Pin 59 about which the pivoting occurs is referred to herein as a pivot pin, the delineator 79 which forms the pivot zone in which the pivot pin 59 pivots is referred to as the pivot delineator, the coupler (e.g. 77) secured to or formed by the member which forms the pivot delineator is referred to as a first non-pivot coupler and the coupler secured to or formed by the member which forms the pivot pin is referred to generally as a second non-pivot coupler.

In addition, the pin (e.g. 59 in FIG. 16) which bears against a hanging surface for hanging purposes is also referred to as a hanging pin while the delineator or slot (e.g. 79) which forms the hanging surface is also referred to as a hanging delineator. In the embodiment of FIG. 16 each of pins 49 and 61 is a hanging pin and each of slots 79 and 61 is a hanging delineator.

Considering FIGS. 6 and 12–16, the support apparatus 11*b* may be configured in any of several different ways. In a preferred embodiment, the apparatus 11*b* has forward and rearward delineators or support strips 97 and 99, respectively. Such strips 97, 99 are separately mounted and located so that the clearance region 83 is of the desired dimension consistent with the relationship between dimensions D1 and D2 described above. However, the apparatus 11*b* may also be configured as a unitary piece which includes the support strips 97, 99 and the clearance region 83 therebetween.

Referring again to FIGS. 16 and 31, to remove shelf 10 from assemblies 11*a* and 11*b*, a user forces shelf 10 upward and then manipulates shelf 10 so that pins 59 and 61 both move toward and into clearance region 83. At the same time pin pair 51 (see FIG. 31) is also forced into clearance region 648 Next, the user places pin pairs 57 adjacent portion 639 (see phantom in FIG. 31) and rotates the opposite shelf end (i.e., the end including pin pair 51) out of in region 648. Finally, the end of shelf 10 in region 83 is removed.

Referring still to FIG. 31, while dimension D6 is preferably greater than dimension D4, most preferably dimension D6 is only slightly greater than dimension D4 so that, unless pin pair 57 is adjacent portion 639, opposite shelf end 640 will not clear coupler edge 650. When so configured, while delineators 7, 8, 660 and 662 facilitate shelf removal via affirmative and specific shelf manipulation (see FIG. 31), the delineators also maintain a shelf within the space between clearance regions 83 and 648 unless the specific manipulation occurs thereby helping a system user maintain control of the shelf during vertical shelf movement.

In the embodiment illustrated in FIG. 31, regions 83 and 648 and edges 630, 634, 632 and 636 are similarly dimensioned so that shelf 10 may be removed in either a forward direction or a reverse direction and by removing either shelf end first. Although this commonly dimensioned design is preferred from a manufacturing perspective (i.e., identical components are less expensive to manufacture than several different types of components), assemblies 11*a* and 11*b* may include delineator and/or clearance regions which have varying dimensions and characteristics such that a shelf can only be removed from a specific location along the frame members. For example, referring to FIG. 32, another inventive embodiment 698 is illustrated which includes two shelves 10*a* and 10*b* in vertical positions with respect to frame members 11*a* and 11*b*. Member 11*a* forms a clearance region 700 while member 11*b* forms a clearance region 702. Each member 11*a* and 11*b* also forms an opening 704, 706, respectively, in their respective clearance regions 700, 702. Openings are at exactly same height and are just large enough for one of the pin pairs to pass through. Facing edges of members 11*a* and 11*b* are identified by numerals 708 and 710. Pin pairs 51*a* and 57*a* extend from opposite edges of shelf 10*a* while pin pairs 51*b* and 57*b* extend from opposite edges of shelf 10*b*.

In embodiment 698 the dimensions and juxtaposition of shelf 10*a*, pin pairs 51*a* and 57*a*, facing frame member edges 708 and 710 and clearance depths 712 and 714 are such that shelf 10*a* cannot be rotated out of the area between regions 700 and 702 as illustrated in FIG. 31. Instead, to remove a shelf in embodiment 698, the shelf must be vertically moved to the position of shelf 10*b* where pin pairs 51*b* and 57*b* are aligned with openings 704 and 706. Then shelf 10*b* can be moved forward (i.e. out of the illustration) for removal.

Referring to FIG. 33, another embodiment 720 is illustrated wherein a single shelf 10*b* is illustrated in a vertical position relative to frame members 11*a* and 11*b*. Elements of shelf 10*b* and members 11*a* and 11*b* which are identical to elements in FIG. 31 are similarly marked. The only distinction between the embodiments of FIGS. 31 and 32 is that, instead of each frame member 11*a* and 11*b* forming an opening, only frame member 11*b* forms an opening 722 for removing a shelf. To remove shelf 10*b* in embodiment 720, pin pair 57*b* is aligned with opening 722, the shelf end adjacent member 11*b* is rotated until pin pair 57*b* is free of member 11*b* and the opposite end of shelf (i.e. adjacent pin pair 51*b*) is removed. In this embodiment, as with the embodiment of FIG. 31, it is contemplated that shelf and frame member dimensions are such that shelf 10*b* cannot be removed from the area between clearance regions 700 and 702 unless shelf 10*b* is positioned so pin pair 57*b* is vertically aligned with opening 722.

Referring to FIG. 34, yet one other embodiment 730 is illustrated wherein shelf 10*b* is in a vertical position relative members 11*a* and 11*b*. Once again elements which are identical between FIGS. 31 and 32 are similarly marked. In this embodiment, instead of providing openings (e.g. 704 and 706 in FIG. 31), a recess 732 is provided in clearance region 708 which extends in the direction opposite member 11*b* and is large enough to receive pin pair 51*b*. Recess 732 forms a distal wall 705 at its deepest point. Here, the "egress" dimension is between wall 705 and edge 710 of frame member 11*b*. In embodiment 730, to remove shelf 10*b*, shelf 10*b* is vertically positioned such that pin pair 51*b* is aligned with recess 732. Then shelf 10*b* is moved laterally (e.g., to the left) so pin pair 51*b* is received within recess 732 and pin pair 57*b* is clear of edge 710. Next, the shelf edge adjacent pair 57*b* is rotated out of the space between clearance regions 700 and 702 and the shelf end adjacent pin pair 51*b* is removed.

Thus, it should be appreciated that many different frame member designs can be configured to enable shelving to be easily removed when specific affirmative manipulative steps are taken but which, when the steps are not taken, constrains shelving movement to help a user control shelving during reconfiguration. All designs having this feature are contemplated by the invention.

Some fixture users may prefer to display certain types of brackets 103 of products, e.g., neckties, purses, belts or the like, by hanging them on hang bar brackets 103 rather than laying them upon shelves 10. Referring now to FIGS. 2, 8, 11 and 12, the new combination of the shelf 10 and support apparatus 11 readily accommodates that preference. A hang bar bracket 103 has an inverted U-shaped bar attachment member 105 defining a dimension E2 only slightly greater than the edge dimension E1. When the shelf edge 69 and bracket 103 are so configured and when the shelf 10 is in a downward, self-stored position as shown in FIGS. 12 and 16, the bracket 103 may be mounted securely on the shelf 10 by slipping the member 105 downwardly over the shelf edge 69. (Considering FIG. 12, it is also to be appreciated that one or more brackets 103 may be mounted on a second type of brace member which takes the form of a hang bar support 101 having end plates 107, each with a pair of pins as described above with respect to the shelf 10.)

Referring to FIGS. 1, 3, 4, 5 and 6, where the store fixture 13 preferably has plural shelves 10 on which products, e.g., dry goods, may be displayed for sale, each support apparatus 11*a*, 11*b* has a plurality of vertically spaced slot sets such as sets 109, 111 and 113. Each slot set 109, 111, 113 includes first and second slots such as 77, 79, respectively, as described above. And as also described above, each of the first and second slots of each slot set 109, 111, 113 has a pin-support portion 81 and a clearance region 83 between the slots. Each shelf 10 of plural shelves 10 and the shelf support apparatus 11 are configured as described above.

As mentioned above, the new store fixture 13 is preferably configured to permit storing, out of sight, unused shelves 10. Referring to FIGS. 2, 3, 4 and 6, the fixture 13 includes the storage section 29 between the lateral stanchions 25, 27. The storage section 29 has the pair of spaced wall members 21, 23 extending between the stanchions 25, 27. In the preferred fixture 13, there is at least one support device 115, e.g., a horizontal, shelf-like "rail" or the like, extending between and affixed to the wall members 21, 23. The wall members 21, 23 and the support device 115 form an elongate storage tunnel 117 for receiving a shelf 10 therein for storage. The end closures 31, 33 permit the storage tunnel 117 to be opened for shelf removal or storage and closed to restore the aesthetic quality of the fixture 13 and to prevent possible shelf theft.

Referring also to FIGS. 2, 3, 4, 12 and 17, each end closure 31, 33 includes an arcuate exterior panel 119 formed of a material which is either translucent or transparent so that light can be transmitted therethrough. An interior panel 121 supports a lamp 123, the light from which is visible through the exterior panel 119. Sales-related text, images or both may be applied to such panel 119.

Referring now to FIGS. 3, 4, 6 and 12, the spaced wall members 21, 23 define a gap 39 between them. An aesthetically pleasing closure member 41, e.g., a finished wood strip or the like is atop the gap 39 and, front to rear, extends between the wall members 21, 23. A vertically sliding sign board 43 extends through a slot 125 in the closure member 41. The sign board 43 can be withdrawn and displayed above the closure member 41 or pushed downwardly into the gap 39 for storage.

Other Embodiments and Features

FIGS. 6–10 and 12–16 show the preferred pin configuration and pin locations. But, as noted above, other pin locations are possible. Referring to FIGS. 6, 8, 10 and 18 (which show the apparatus 11*a* which is to the viewer's left when such viewer is viewing the fixture 13 along the viewing axis VA of FIG. 6), the first pin 55 is located so that the top surface 71 of the shelf 10 is tangent therewith and the second pin 53 is located so that the shelf edge 69 is tangent thereto and the pin 53 is closely proximate the shelf bottom surface 73. To state it another way (and when the shelf 10 is horizontal), the pin center axes 127, 129 are coincident with separate horizontal planes 131, 133, respectively, which are vertically spaced apart.

The first and second slots 137, 139, respectively, are relatively located so that when the pins 53, 55 are in the pin support portions 143, 141 of such slots 139, 137, respectively, the shelf 10 is horizontal. From the foregoing, it is apparent that shelves 10 of differing thickness and having pins differently located thereon can nevertheless be accommodated by appropriate slot location.

As used herein, the term "support pin" and like terms means any structural component protruding from a shelf end surface for shelf support. Unless the context requires otherwise, a support pin may have any cross-sectional shape. For ease of manufacture and use, support pins with circular cross-sectional shapes are highly preferred.

Unless the context requires otherwise as, (e.g., in the case of a shelf 10 and support apparatus 11*a*, 11*b* which are part of a retail store fixture for displaying products for sale), the term "shelf" means a generally planar structure supporting or capable of supporting persons or things. As non-limiting examples, a worker's scaffold, a household closet, an entertainment center, a desk top and a store display fixture 13 would all include a shelf.

In all of the inventive embodiments, each embodiment includes at least first, second, third and fourth couplers where two of the couplers are pins and the other two couplers are slot delineators. While the embodiment described above includes pins connected to a shelf or brace member and delineators connected to or formed by support or frame members, it should be appreciated that the invention is broad enough to cover many other embodiments. For example, referring to FIGS. 19A and 20, in a second embodiment a single member 211 extends from and forms slot delineators 200 and 202 on a shelf edge 201 while pins 204 and 206 which cooperate with delineators 200 and 202 extend from support members 208 (only one illustrated). In FIG. 20, pins 204 and 206 define a coupling plane 217 adjacent and parallel to a vertical surface of frame member 208. Referring also to FIGS. 19C–19D, delineator 200 forms a pivot zone 203 and also forms a hanging surface 220. In addition, each of the delineators 200 and 202 forms a support surface 212, 214, respectively, and, referring to FIG. 19B, forms a passageway 225, 227 which defines a path 221, 223 (see FIG. 19E) from a corresponding support surface 212, 214, respectively. The passageways 221, 223 are each wide enough for one of the pins to pass through.

In FIGS. 19A–19E, shelf 210 is shown in a number of positions as shelf 210 is first mounted to frame member 208 in a horizontal position and then as shelf 210 is moved from the horizontal position to a vertical hanging position. Referring to FIGS. 19A and 20, to mount shelf 210 to pins 204 and 206, shelf 210 is positioned such that delineator 200 is above pin 204. Although not illustrated, a similar delineator on the opposite end of shelf 210 is also aligned with a pin. With shelf 210 so positioned, shelf 210 is angled so pin 204 enters passageway 225. Then shelf 210 is pulled forward until delineator 202 drops over pin 206. At this point pins 204 and 206 bear against support surfaces 212, 214 respectively and shelf 210 is supported in the horizontal position (see FIG. 19C).

To move shelf 210 to the vertical storage position, the front end of shelf 210 is lifted so that pin 206 is below delineator 202. Then, shelf 210 is pushed back so that pin 204 is within zone 203 (see FIG. 19D). At this point, shelf 210 can be rotated downward about pin 204. Delineator 202 is dimensioned and juxtaposed with respect to zone 203 such that, during rotation of shelf 210 about pin 204, delineator 202 does not contact pin 206. In other words, as shelf 210 is rotated, pin 206 is outside the path swept by delineator 202 and member 211 so that shelf 210 is rotated into the vertical position unobstructed. Once member 211 has passed pin 206, pin 204 is received on arcuate hanging surface 220 for vertical storage (see FIG. 19E).

Referring again to FIG. 19A, pins 204 and 206 form a "clearance region" generally referred to by numeral 222. Referring also to FIG. 13, the clearance region 83 in the embodiment illustrated in FIG. 13 is clearly delineated as the area between surfaces 85 and 87. In the embodiment illustrated in FIG. 19A, referring also to FIG. 20, the clearance region 222 is the entire region which resides in coupling plane 217 along the surface of wall 208. Thus, herein, the term "clearance region" is generally taken to mean any region which is coplanar with the couplers which are connected to a frame or support member 208 and which is outside an area defined by any one of the couplers on the frame or support member 208.

Referring to FIG. 19E, when shelf 210 is mounted to member 208 in the vertical position, each of paths 221 and 223 opens into clearance region 222. As indicated above, each of paths 221, 223 is wide enough that a pin (e.g. 204, 206) can pass therethrough. By moving shelf 210 perpendicular to the longitudinal axis (see 231 in FIG. 20) of shelf 210, shelf 210 can be manipulated such that each of the first and second pins pass through their respective paths 221, 223 and the couplers on the shelf are both within clearance region 222. When so positioned shelf 210 is de-coupled from support member 208.

Referring still to FIG. 19A, as indicated above, it should be appreciated that a second frame member similar to member 208 is preferably positioned opposite member 208 and is coupleable to an opposite end of shelf member 210. To this end, the embodiment preferably includes fifth, sixth, seventh and eighth couplers at the opposite shelf end wherein two of the fifth through eighth couplers are similar to pins 204 and 206 and the other two of the fifth through eighth couplers are similar to delineators 200 and 202. In the present embodiment the two couplers connected to shelf 210 are delineators which form additional passageways which define paths while the couplers connected to the other support member are pins which define a second clearance region (not illustrated) which is essentially identical to region 222.

Referring now to FIG. 21, in a third embodiment, like the second embodiment, a single member 241 forms slot delineators 230, 232 on a shelf edge while pins 234, 236 which cooperate with delineators 230, 232 are connected to support members 238 (only one support member illustrated). Member 238 and pins 234, 236 are identical to member 208 and pins 204, 206 (see FIG. 19A) and therefore are not described again in detail. Similarly, delineator 232 is similar to delineator 202 (see FIG. 19A) and therefore is not again described. However, delineator 230 is unique in that delineator 230 opens upwardly and to a rear of a shelf 240. In this example a pivot zone is identified by number 242 and a support surface is identified by member 245. In light of the explanation above with respect to FIGS. 19A–20, operation of the embodiment of FIG. 21 should be clear to one skilled in the art and therefore a detailed explanation is forgone here. However, one distinction between operation of the second and third embodiments is of import. To this end, although not illustrated, it should be noted that while delineators 202 and 232 have a similar design and while delineator 202 may or may not define a hanging surface, delineator 232 does form a hanging surface 247 which would cooperate with another pin (not illustrated) below pin 234 to support shelf 240 in the vertical position.

While each of the first and second delineators in the second and third embodiments are illustrated as being formed by a single extension member, each may be separately formed. For example, referring to FIGS. 22 and 23, and also to FIG. 21, each of the limiting surfaces in FIG. 21 are also provided in the embodiment of FIGS. 21 and 23 by separate first and second delineator extensions 250, 252. Extension 250 forms pin support surface 254 and a hanging surface 256 while extension 252 forms pin support surface 258 and a pivot zone 260. In light of the description above, one of ordinary skill in the art should understand operation of the embodiment of FIGS. 22 and 23 and therefore operation is not explained here in detail.

Referring to FIG. 24, yet another preferred embodiment is illustrated which includes pins 270 and 272 connected to a shelf 288 (shown in phantom) and which cooperate with separate delineators or delineator members 274, 276 extending from a support or frame member 278. Delineator 274 forms a pin support surface 280, a pivot zone 282 (in phantom) and a hanging surface 284 while delineator 276 forms an upwardly facing arcuate pin support surface 286. Shelf 288 is illustrated in a horizontal position with pin 270 bearing against surface 280 and pin 272 bearing down on surface 286.

To move shelf 288 from the horizontal to the vertical positions shelf 288 is rotated slightly upwardly so that pin 272 is above surface 286, shelf 288 is moved forward so pin 270 moves into pivot zone 282 and shelf 288 is rotated downward about pin 270 into the vertical position. With pin 270 in zone 282, when shelf 288 is rotated, pin 272 is unobstructed by delineator 276. Once shelf 288 is vertical, shelf 288 is lowered until pin 270 bears upon hanging surface 284 and shelf 288 is supported thereby.

Referring still to FIG. 24, to dismount shelf 288 from support member 278, a user grasps and raises shelf 288 and then moves shelf 288 toward delineator 276 such that pin 270 passes through passageway 290 and into clearance region 292 (i.e. the region within the plane of delineators 274, 276 along the surface of member 278 which is not within one of the delineator prescribed passageways).

Referring now to FIG. 25, another and preferred embodiment 300 of the invention is illustrated. Embodiment 300 is similar to the first embodiment (see FIGS. 7 and 13 through 16) in that pins 302 and 304 are mounted to a shelf member 306 show in phantom) while support strips 308, 310 are mounted to a frame member 312. In FIG. 25, frame member 312 has an aft end 313, a fore end 315, a top 317 and a bottom 319. Shelf member 306 has first and second oppositely facing surfaces 350, 352, respectively.

Each of strips 308 and 310 forms a plurality of vertically spaced slot delineators. Exemplary facing delineators include delineator 314 and delineator 316. Other facing delineators include delineators 372 and 376. Facing delineators form coupler or delineator pairs and the delineators in each pair are mirror images of each other. For example, delineators 314 and 316 form a coupler pair and, in this example, are mirror images of each other. To this end, delineator 314 forms a passageway (generally 318) having a first support surface 320, a pivot zone 322 (in phantom) and a hanging surface 325. Similarly, delineator 316 forms a passageway (generally 324) having a second support surface 326 and a pivot zone 328 (in phantom). In addition, second support surface 326 doubles as a hanging surface. A clearance region 340 is formed between strips 308 and 310 and each of delineators 314, 316 opens into region 340.

Referring still to FIG. 25, as illustrated, pins 302 and 304 are spaced along the shelf edge such that shelf 306 can be positioned in a first horizontal position wherein pin 304 bears down on surface 326 and pin 302 bears up against surface 320. When in this first position, surface 350 faces upward. To decouple shelf 306 from member 312, shelf 306 is rotated about pin 302 so pin 304 is above surface 326. Shelf 306 is manipulated such that pin 302 and pin 304 follow paths 356, 358, respectively, and simultaneously. With pin 302 in pivot zone 322, shelf 306 is rotated down until pin 304 is within clearance region 340. Next, shelf 306 is manipulated so that pin 302 passes back along path 356 and exits delineator 314 into region 340. With pins 302 and 304 in region 340, affirmative manipulative steps consistent with the frame member design are then taken to remove the shelf.

Referring to FIG. 26, embodiment 300 is illustrated in a second horizontal configuration where, unlike the position in FIG. 25, shelf surface 352 faces upward. To this end, in addition to the surfaces and zones described above, delineator 316 further defines a fourth support surface 360 and another pivot zone 362. In addition, surface 325 doubles as a third support surface. In the second horizontal position pin 304 bears down on surface 325 while pin 302 bears up on surface 360. Shelf 306 can be decoupled from its second horizontal position in a manner similar to that described above and therefore, the decoupling method is not explained again in detail.

It should be appreciated that in addition to having different surfaces (e.g. 350, 352 in FIGS. 25 and 26) facing upward, the first and second horizontal positions also can be used to change the direction in which shelf 306 extends (i.e. fore or aft).

The advantages associated with being able to easily flip shelf 306 over are numerous and, among others, include being able to place different advertisements on opposite shelf sides, providing different shelf looks (e.g. light and dark wood) on opposite shelf sides, placing a mirror on one shelf side and so on. It should also be noted that if it is desirable to have shelf 306 extend to fore side 315 of member 312 with surface 352 facing upward, shelf 306 can be removed from member 312, flipped over and remounted to member 312 to facilitate the desired effect. A similar manipulation can be performed to configure shelf 306 to extend to aft side 313 with surface 350 facing upward.

Referring now to FIGS. 27–30, four other configurations which are achievable using embodiment 300 are illustrated. In FIG. 27 shelf 306 is illustrated in a first or aft downward vertical position wherein surface 350 faces fore side 315 and pins 302 and 304 bear against surfaces 325 and 370, surface 370 being formed by delineator 372 below delineator 314. FIG. 28 shows shelf 306 in a second or fore downward vertical position wherein surface 350 also faces fore side 315 but wherein pins 302 and 304 bear against surfaces 326 and 374, surface 374 being formed by delineator 376 below delineator 316. Each of the first and second vertical positions is similar and yet provides a slightly different visual appearance.

Referring to FIG. 29, shelf 306 is illustrated in a first upright vertical position wherein pins 304 and 302 are received by and bear against surfaces 325 and 370, respectively, and surface 352 faces fore side 315. In FIG. 30, shelf 306 is illustrated in a second upright vertical position wherein pins 304 and 302 are received by, and bear against, surfaces 326 and 374, respectively, and surface 352 faces fore side 315. With respect to which surface 350 or 352 faces the fore side in the upright and downward fore and aft vertical positions, as in the case of which surface 350 or 352 faces upward when shelf 306 is in the horizontal positions, it should be appreciated that shelf 306 can be removed, flipped over and remounted to change the fore facing surface. For instance, in FIG. 27, shelf 306 can be removed, flipped and replaced so that surface 352 faces fore side 315 and surface 350 faces aft side 313. Once again, the ability to modify the fore facing surfaces is valuable for advertising and for changing the look of a shelving unit.

Referring now to FIG. 35, one other embodiment 400 of the invention is illustrated. Referring also to FIG. 16, embodiment 400 is identical to the FIG. 16 embodiment with one exception. The unique feature of embodiment 400 is that slots 402 and 403 on an aft side 405 of member 11*b* are much deeper than slots 79 and 95. Specifically, slots 402 and 403 are formed deep enough that when a first shelf 404 (shown in phantom) is in a vertically supported position with pins 405 and 408 bearing on surfaces 410 and 412, in addition to being moved vertically passed the first shelf 404, a second shelf 414 (shown in phantom) can be horizontally supported adjacent (i.e. to the fore side of first shelf 404) the vertical first shelf 404. In addition, slots 402 and 403 are deep enough that when aft pin 416 is in a pivot zone 424 so fore pin 418 can be rotated into a clearance region 426 without obstruction, a rear edge 428 of shelf 414 will not contact shelf 404.

With embodiment 400 it should be appreciated that one or more shelves can be horizontally positioned adjacent a vertically hanging shelf thereby increasing configuration capabilities of the inventive system.

In addition to providing frame members which facilitate shelf removal by affirmative specific manipulation wherein a shelf is removed by movement fore or aft, another embodiment facilitates removal laterally. To this end, referring to FIG. 36, another embodiment 500 is illustrated. Embodiment 500 is similar to the embodiments described above and therefore most features are not again described here in detail. The primary distinction in embodiment 500 is that a frame member 502 forms a lateral opening 506 within a clearance region 504 which is dimensioned so that a shelf 510 may pass laterally for dismounting and storage. Preferably, only one opening 506 is formed so that member 502 and an associated frame member (not illustrated) generally cooperate to help control a shelf member during vertical movement between facing clearance regions. In this regard it should also be recognized that by providing the tops and/or bottoms of frame members open a shelf could be removed either through the top or the bottom.

Referring now to FIGS. 37 through 40, yet another embodiment 800 of the invention is illustrated. While the previously described embodiments are capable of supporting a shelf in any of several different essentially vertical and horizontal positions, it has been recognized that, in addition to the vertical and horizontal positions, it may be advantageous to have one or more shelf members supported in an angled position. To this end, in addition to being able to support a shelf member in several vertical and horizontal positions, the embodiment of FIGS. 37 through 40 can also support shelf members in several different angled positions.

As in the embodiments above, embodiment 800 includes a shelf member 810 (shown in phantom) having first and second couplers 812, 814 extending laterally from a lateral edge. Similar first and second couplers extend from the oppositely facing lateral edge (not illustrated) of member 810. In the illustrated embodiment first and second couplers 812 and 814 are pins. Forward and reward support strips 802, 804, respectively, define a clearance region 806 therebetween on a first lateral side of shelf member 810. Although not illustrated, similarly configured support members are also provided adjacent the opposite lateral edge of shelf member 810. Each strip 802, 804 forms a plurality of third and fourth couplers, each third coupler formed by strip 802 and identified by numeral 816 followed by a lower case letter (e.g., a, b, c, etc.) to distinguish one third coupler from another. Similarly, couplers formed by strip 804 are identified by numeral 818 followed by a lower case letter. Each third and each fourth coupler is a slot or a slot delineator in this preferred embodiment.

While slots in strips 802 and 804 are similarly shaped, there are two primary distinctions between the slots which are worth noting. First embodiment 800 includes twice as many slots in strip 802 as in strip 804. Second, slots in strip 804 are much deeper than slots in strip 802. For example, compare slot 816*a* and slot 818*a* wherein slot 818*a* is relatively deep. These two distinguishing features, additional slots and deeper slots in strip 804, facilitate angled shelf member support.

Referring specifically to FIG. 37, shelf member 810 is shown in a horizontal supported position with pin 812 received within a recess 820*a* in slot 816*a* and pin 814 bearing against an upper surface 822 of slot 818*a*. It should be appreciated that shelf member 810 can be manipulated out of the horizontal position illustrated by lifting a distal shelf end (not illustrated) so pin 812 is above recess 820, forcing shelf 810 backward so that pin 814 is within a pivot region 824 (shown in phantom) in slot 818*a* and so that pin 812 can swing into clearance region 806 essentially unobstructed.

Referring also to FIG. 38, if manipulated properly, pin 812 can be moved into a support recess 820*b* of a second third coupler or slot 816*b* which is vertically spaced below slot 816*a*. Because slot 818*a* is relatively deep, pin 814 remains therein and bears against upper surface 822 when downward pressure is applied to the distal end of shelf member 810. Comparing shelf member positions in FIGS. 37 and 38, member 810 in FIG. 38 is angled downwardly and yet is fully supported.

Referring now to FIGS. 38 and 39, just as the angled position in FIG. 38 is achievable via shelf manipulation, so to the angled position of FIG. 39 is achievable wherein pin 812 is received within a recess 820*d* of yet another third coupler or slot 816*d* and pin 814 bears against upper surface 822 of slot 818*a*. In the position of FIG. 39, pin 814 bears against surface 822 at a point closer to clearance region 806 than in the position of FIG. 38. Nevertheless, the position of FIG. 39 is still fully supported.

Referring still to FIG. 39, although not illustrated, it is contemplated that shelf member 810 can be manipulated such that pin 812 is received and supported within slot 816*c* and member 810 is supported in yet a third downwardly angled position which is steeper than the position of FIG. 38 but not as steep as the position of FIG. 39.

Referring to FIG. 40, shelf member 810 may also be manipulated such that pin 812 is received within a slot above the slot which receives pin 814 so that shelf member 810 is supported in an upwardly angles position. As illustrated, pin 812 is received within recess 820*a* and so that pin 814 bears upwardly against an upper surface 826 of slot 818*b*. Just as several downwardly angled shelf positions are contemplated, several upwardly angled positions are also contemplated. In addition, although not illustrated, it should be appreciated that the spacing of slots in strips 802 and slots in strips 804 should be such that pins 812 and 814 can be received within vertically separated slots for vertical shelf storage.

Referring now to FIG. 41, a support assembly 850 is illustrated which can be used with any of the embodiments described above to facilitate angled shelf support. Referring also to FIG. 43, bar assembly 850 is to be used with a shelf member 860 (shown in phantom) and strips 862 and 864 similar to the embodiments described above. To this end, shelf member 860 includes at least a first coupler 878 which extends from a lateral shelf edge and also forms a planar undersurface 880. In the illustrated embodiment another coupler 876 also extends laterally in the same direction as coupler 878 and each of couplers 876 and 878 are pins. In addition, strips 862 and 864 form forward and reward couplers, forward couplers being slots identified by numeral 866 followed by a lower case letter to distinguish one from another and rearward couplers also being slots identified by numeral 868 and followed by a lower case letter to distinguish one slot from others.

Referring again to FIG. 41, assembly 850 includes a bar 851 having second couplers 853 and 855 in the form of pins extending from opposite bar end surfaces. Referring also to FIG. 42, bar 851 is preferably rectilinear in cross-section having oppositely facing first and second sides 852 and 854, respectively, and oppositely facing third and fourth sides 856, 858, respectively. Pin 853 is positioned a unique distance away from each of surfaces 852, 854, 856 and 858. Thus, pin 853 is a first distance D8 from surface 852, a second distance D9 from surface 854, a third distance D10 from surface 856 and a fourth distance D11 from surface 858 and each of distances D8 through D11 are different.

In operation, referring still to FIG. 43, assembly 850 is mounted at either end to forward lateral support strips (e.g. 862) by placing pins (e.g., 853) within slot recesses (e.g., 870). When so mounted, bar 851 can rotate about pins 853 and 855 so that any of surfaces 852, 854, 856 or 858 faces generally upwardly. In FIG. 43, surface 858 faces upwardly.

To support shelf 860 at an angle with assembly 850 mounted between facing strips (e.g. 862), shelf 860 is manipulated such that pin 878 is received within slot 868*a* and shelf 860 is above bar 851. Then shelf 860 is lowered until undersurface 880 rests on surface 858. Undersurface 880 abuts flatly against surface 858 and therefore prohibits bar 851 rotation. In this position pin 876 is within a clearance region 882 between strips 862 and 864 and pin 878 bears against an upper surface 884 of slot 868*a*. Pin 876 bears against a surface of clearance region 882 and therefore prohibits movement of shelf member 860. Bar 851 supports shelf 860 at a first angle A1 with respect to a horizontal plane as illustrated.

Referring now to FIG. 44, to modify the angle at which shelf 860 is supported, the distal end of shelf 860 can be lifted and bar 851 can be rotated so that a different bar surface (e.g., 852, 854, 856) faces upwardly. Shelf 860 is lowered so that undersurface 880 rests on the generally upwardly facing surface. For instance, in FIG. 44, surface 854 faces upward. Referring to FIGS. 42, 43 and 44, because distances D4 and D2 are different, the angel A2 formed by shelf 860 is different when surface 880 rests on surface 854 than when surface 880 rests on surface 858. Similarly, two other angles can be configured by rotating bar 851 so that one of the other two surfaces (e.g., 852, 856) faces upwardly. Preferably, distances D8 through D11 are selected such that standard viewing angles (e.g., 15°, 30°, etc.) are achievable.

Other embodiments of the invention are contemplated. For example, referring again to FIGS. 37 through 40, while first and second couplers 812 and 814 are pins while third and fourth couplers 816 and 818 are slots, other embodiments may include first and second couplers which are slots and third and fourth couplers which are pins. Similar comments can be made with respect to the embodiment described by reference to FIGS. 41 through 44.

In addition, while assembly 580 in FIG. 41 preferably includes four surfaces which are uniquely spaced from pins 853 and 855, other designs are contemplated wherein less or more than four surfaces may be included on bar 851. For instance, one embodiment may include a spiral which includes a smooth surface which wraps around coupler pins, any point on the surface being a unique distance from the pins when compared to any other point. This type of bar would enable a shelf to be supported in virtually any angled position.

Referring to FIG. 45, an angle support 900 which can be used to support a shelf in an angled position is illustrated. Support 900 is a rigid block including a top surface 902, a bottom surface 903 opposite top surface 902, a front surface 904, a rear surface opposite front surface 904 and two lateral surfaces 906 and 908. A width dimension W is between surfaces 906 and 908 while a girth dimension G is between front surface 904 and the oppositely facing rear surface. A channel 910 is formed in bottom surface 903 which extends approximately three quarters of the way toward top surface 902 and traverses the distance between front surface 904 and the oppositely facing rear surface (not illustrated). Channel 910 has a width which is wide enough to accommodate one of the pins (e.g. 59 or 61 in FIG. 16) extending laterally from a shelf member.

Referring also to FIG. 46, a frame/support assembly 11*b* and shelf 10 like the assembly and shelf of FIG. 16 is illustrated. Clearance region 83 is defined by a dimension D5 and has a depth D6 (see D6 in FIG. 12). Width W and girth G are slightly less than dimensions D5 and D6, respectively, of clearance region 83 such that support 900 is snugly receivable within region 83 as illustrated in FIG. 46. When in region 83, support 900 can be slid vertically up and down unless impeded by a shelf 10.

To support a shelf 10 in an angled position, two supports 900 are used. A separate support 900 is positioned in each of two facing clearance regions 83 (only one support 900 illustrated in FIG. 46). Then, with blocks 900 above shelf 10, shelf 10 is manipulated such that a rear pin 59 is received in a slot 79 while pin 61 is within clearance region 83. Next, each of supports 900 is slid down such that pins (e.g. 61) in region 83 are received in channels 910. When so positioned, supports 900 cooperate with slots (e.g., 79) to maintain shelf 10 angled as illustrated. To this end, slot 79 restricts downward shelf movement while supports 900 restrict horizontal movement.

The embodiment of FIGS. 45 and 46 is thought to be relatively less expensive to manufacture than the previously described embodiments which support angled shelves and therefore is considered advantageous.

While the principles of the invention have been shown and described in connection with preferred embodiments, it is to be understood clearly that such embodiments are by way of example and are not limiting. To apprise the public of the scope of the present invention the following claims are made.

What is claimed:

1. A support apparatus comprising:

at least one rigid frame member;

at least one shelf member having a longitudinal axis and an end surface coincident with the axis;

a first coupler pair including first and second couplers mounted to the end surface and a second coupler pair including third and fourth couplers mounted to the frame member within a coupling plane, the second pair delineating at least one clearance region within the coupling plane, the couplers operative to selectively mount and dismount the shelf member to the frame member;

the couplers including first and second pins and first and second slot delineators, the first and second delineators defining first and second pin support surfaces and forming first and second passageways from the first and second support surfaces, respectively, each passageway wide enough for one of the pins to pass through;

when the shelf member is mounted to the frame member, the pins are essentially parallel to the axis and bearing against the support surfaces, the passageways defining paths which are essentially perpendicular to the axis, are within the coupling plane and which open into the clearance region, wherein:

with the first and second pins received on the first and second support surfaces, respectively, the shelf member is supported in a first position and the paths are essentially perpendicular to the axis, within the coupling plane and open into the clearance region so that the shelf member is dismountable from the frame member by moving the shelf member essentially perpendicular to the axis such that the pins pass through the paths and the first and second couplers pass into the clearance region.

2. The apparatus of claim 1 wherein the first and second pins are connected to the shelf member.

3. The apparatus of claim 1 wherein the clearance region is between the second pair.

4. The apparatus of claim 1 wherein the first position is an essentially horizontal position.

5. The apparatus of claim 1 wherein the third and fourth couplers are upper couplers and further including a lower coupler pair including lower third and fourth couplers which are identical to the upper third and fourth couplers and which are mounted to the frame member vertically below the third and fourth couplers, respectively, such that the second coupler pair and the lower coupler pair are operative to support the shelf member in a second position vertically below the first position with the first and second pins received on lower coupler support surfaces, respectively, the clearance region defining at least one clearance path within the coupling plane between the second and lower coupler pairs which is wide enough for the first and second couplers to pass through.

6. The apparatus of claim 5 including first and second support strips, the first support strip forming the third couplers and the second support strip forming the fourth couplers.

7. The apparatus of claim 5 further including a hanging delineator which forms a hanging surface and a hanging pin, one of the hanging surface and hanging pin linked to the shelf member and the other of the hanging surface and hanging pin linked to the frame member, when the shelf member is mounted to the frame member, the hanging surface and hanging pin essentially parallel to the axis and within the coupling plane and, wherein, the hanging delineator and hanging pin are operative to mount and support the shelf member in an essentially vertical position with the hanging pin received on the hanging surface.

8. The apparatus of claim 7 wherein one of the delineators forms the hanging surface.

9. The apparatus of claim 8 wherein one of the coupler pins forms the hanging pin.

10. The apparatus of claim 9 wherein the upper third coupler is one of the hanging delineator or the hanging pin and the upper and lower third couplers are vertically spaced such that, when the shelf member is supported in the vertical position, each of the first and second pins is received within a separate one of the third delineators.

11. The apparatus of claim 8 wherein each of the coupler pins is operative as the hanging pin.

12. The apparatus of claim 11 wherein the second coupler pair couplers are separated by the clearance region, the coupler mounted to the shelf member which is operative along with second coupler pair for hanging purposes is a hanging coupler and, the hanging coupler is operative with the upper third coupler to support the shelf member in the vertical position on a first side of the clearance region wherein the vertical position is an aft position.

13. The apparatus of claim 12 wherein the shelf member is a first shelf member, the apparatus further including at least a second shelf member mountable and dismountable to the frame member, the first and second shelf members dimensioned such that, when the first shelf member is in the vertical position and the couplers mounted to the second shelf member are within the clearance region, the clearance region forms a path such that as the second shelf member is moved vertically past the first shelf member, the first shelf member is outside a shelf path swept by the second shelf member.

14. The apparatus of claim 12 wherein the hanging coupler is also operative with the upper fourth coupler to support the shelf member in a fore vertical position on a second side of the clearance region.

15. The apparatus of claim 14 wherein the hanging coupler is operative with the lower third coupler to support the shelf member in a third vertical position on the first side of the clearance region and is also operative with the lower fourth coupler to support the shelf member in a fourth vertical position on the second side of the clearance region.

16. The apparatus of claim 5 further including a plurality of second coupler pairs vertically spaced below the third and fourth couplers, each second coupler pair operative in conjunction with the first coupler pair to support the shelf member in a distinct position.

17. The apparatus of claim 16 wherein the coupler pairs are equispaced along the frame member.

18. The apparatus of claim 1 wherein one of the delineators is a pivot delineator and also forms a pivot zone, the coupler in the same pair as the pivot delineator being a first non-pivot coupler, the pin which is received by the pivot delineator being a pivot pin and the coupler in the same pair as the pivot pin being a second non-pivot coupler, wherein, the pivot delineator and the first non-pivot coupler are spaced and the pivot pin and the second non-pivot coupler are spaced such that when the pivot pin is inside the zone, the shelf member is rotatable from the first position to an essentially vertical position about the pivot pin such that the non-pivot coupler on the frame member is outside a path swept by the non-pivot coupler on the shelf member.

19. The apparatus of claim 1 wherein the shelf member includes a brace member and a wall member, the brace member including a base member and two lateral members extending in the same direction form opposite ends of the base member, the wall member traversing the distance between the lateral members, the brace member formed of a first material and the wall member formed of a second material, the first material being more rigid than the second material, the first and second couplers mounted to the brace member.

20. The apparatus of claim 19 wherein the brace material is metallic.

21. The apparatus of claim 1 wherein the frame member is a first frame member, the apparatus further includes a second frame member which forms a second essentially vertical frame surface, a second coupling plane parallel to the second frame surface, the end surface is a first end surface and the shelf member forms a second end surface, the first and second end surfaces facing in opposite directions, the apparatus further including a third coupler pair including fifth and sixth couplers connected to the second end surface and a fourth coupler pair including seventh and eighth couplers connected to the second frame member, the fourth pair delineating a second clearance region within the second coupling plane, the couplers including third and fourth pins and third and fourth slot delineators, the third and fourth delineators defining third and fourth pin support surfaces, respectively, the third and fourth delineators forming third and fourth passageways from the third and fourth support surfaces, respectively, each passageway wide enough for one of the pins to pass through, when the shelf member is mounted to the brace member, the pins essentially parallel to the axis, each of the third and fourth passageways defining third and fourth paths which are essentially perpendicular to the axis, are within the second coupling plane and which open into the second clearance region, wherein:

when the shelf member is mounted to the frame member in the first position, the third and fourth pins are received on the third and fourth support surfaces, respectively, the third and fourth paths are essentially perpendicular to the axis, within the second coupling plane and opening into the second clearance region so that the shelf member is dismountable from the frame member by moving the shelf member perpendicular to the axis such that the third and fourth pins pass through the third and fourth paths and the fifth and sixth couplers pass into the second clearance region.

22. The apparatus of claim 21 wherein the first and second pins are connected to the first end surface and the third and fourth pins are connected to the second end surface.

23. The apparatus of claim 21 wherein, the first position is a horizontal position and when a pin is within the pivot zone, the shelf member is angled with respect to a horizontal plane.

24. The apparatus of claim 1 wherein a single member forms the first and second delineators.

25. The apparatus of claim 1 wherein the frame member includes a front end and a rear end, the third and fourth couplers are front third and fourth couplers connected to the front end and the apparatus further includes rear third and fourth couplers connected to the rear end to selectively link and de-link the shelf member to the rear end in another position wherein the shelf member is precluded from downward movement.

26. The apparatus of claim 25 wherein a storage space separates the front and rear ends.

27. The apparatus of claim 26 wherein the apparatus further includes first and second spaced wall members separated by the storage space.

28. The apparatus of claim 27 wherein the first and second walls form an elongate storage tunnel and wherein the apparatus further includes an end closure mounted for movement with respect to the frame member, thereby permitting the storage tunnel to be opened and closed.

29. The apparatus of claim 1 wherein the apparatus further includes first and second spaced wall members separated by a gap, a closure member including first and second oppositely facing surfaces and a mounting mechanism for mounting the closure member atop the gap and a sign board mounted to the first closure member surface such that the closure member and sign board are mountable in two positions with respect to the gap, the positions including a first position wherein the board is received within the gap and the first closure member surface closes the gap and a second position wherein the board is above the gap and the second closure member surface closes the gap.

30. The apparatus of claim 1 wherein the third coupler is a first third coupler and the apparatus further includes a second third coupler which is vertically spaced with respect to the first third coupler and, wherein, the first, second and fourth couplers and the first third coupler are juxtaposed such that the couplers can support the shelf member in a second position which is different than the first position.

31. The apparatus of claim 30 wherein the first third coupler forms the first support surface and the second third coupler forms another support surface, the fourth coupler forms the second support surface and the first and second couplers are pins and, wherein, when the shelf member is in the second position, one of the pins bears against the second support surface and the other of the pins bears against the another support surface.

32. The apparatus of claim 31 wherein there are several third couplers vertically spaced with respect to the first third coupler and wherein any of at least a subset of the third couplers may cooperate with the first, second and fourth couplers to support the shelf member in an angled position.

* * * * *